US009199810B2

(12) United States Patent
Shimoyama et al.

(10) Patent No.: US 9,199,810 B2
(45) Date of Patent: Dec. 1, 2015

(54) SHEET SUPPLY APPARATUS AND IMAGE FORMING APPARATUS

(71) Applicant: KONICA MINOLTA, INC., Chiyoda-ku, Tokyo (JP)

(72) Inventors: Atsuhiko Shimoyama, Tahara (JP); Noboru Oomoto, Toyokawa (JP); Hiroaki Umemoto, Neyagawa (JP); Hiroshi Mizuno, Aisai (JP); Ryo Oshima, Anjo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/337,916

(22) Filed: Jul. 22, 2014

(65) Prior Publication Data

US 2015/0029525 A1 Jan. 29, 2015

(30) Foreign Application Priority Data

Jul. 24, 2013 (JP) ..... 2013-153427

(51) Int. Cl.

| | |
|---|---|
| ***G06K 15/00*** | (2006.01) |
| ***B65H 3/12*** | (2006.01) |
| ***B65H 3/08*** | (2006.01) |
| ***B65H 3/48*** | (2006.01) |
| ***B65H 7/16*** | (2006.01) |
| *B65H 5/08* | (2006.01) |
| *B65H 3/40* | (2006.01) |
| *G01B 11/28* | (2006.01) |

(52) U.S. Cl.

CPC ..... *B65H 3/08* (2013.01); *B65H 3/128* (2013.01); *B65H 3/48* (2013.01); *B65H 7/16* (2013.01); *B65H 2511/20* (2013.01); *B65H 2511/22* (2013.01); *B65H 2515/11* (2013.01); *B65H 2553/42* (2013.01)

(58) Field of Classification Search

None

See application file for complete search history.

(56) References Cited

U.S. PATENT DOCUMENTS

| | | | | |
|---|---|---|---|---|
| 7,663,769 | B2 * | 2/2010 | Hayashihara et al. | 356/630 |
| 8,444,138 | B2 * | 5/2013 | Taki | 271/108 |
| 2010/0129127 | A1 * | 5/2010 | Suzuki | 399/388 |

FOREIGN PATENT DOCUMENTS

JP 2010254462 A 11/2010

* cited by examiner

*Primary Examiner* — Ashish K Thomas
*Assistant Examiner* — Neil R McLean
(74) *Attorney, Agent, or Firm* — Holtz, Holtz, Goodman & Chick PC

(57) ABSTRACT

A sheet supply apparatus includes: a tray on which a stack of sheets can be placed, an air blowing section that blows air towards the stack of sheets to float at least a topmost sheet, a sucking and conveying section, above the tray, that sucks said floating sheet(s) and conveys said sheet(s) in a prescribed direction, and a first light source that emits a first stripshaped slit light having a vertically extending component such that the slit light crosses at least a first edge of a first floating sheet and a second edge of a second floating sheet. An image capture section captures an image of the first slit light, a calculating section calculates a vertical clearance between the first and second sheets, and an air amount adjusting section adjusts an amount of air to be blown by the air blowing section based on the calculated vertical clearance.

26 Claims, 29 Drawing Sheets

21, 53, 53c, 53e, 53f

SHEET SUPPLY APPARATUS AND IMAGE FORMING APPARATUS

This application is based on Japanese Patent Application No. 2013-153427 filed on Jul. 24, 2013, the content of which is incorporated herein by reference.

BACKGROUND OF THE INVENTION

1. Field of the Invention

The present invention relates to a sheet supply apparatus and an image forming apparatus that pick up one sheet at a time from a stack of sheets by using air pressure and feed the sheet to a conveying path.

2. Description of Related Art

As an invention related to a conventional sheet supply apparatus, a sheet supply apparatus described in Japanese Patent Laid-Open Publication No. 2010-254462, for example, is known. FIG. 35 illustrates the structure of a sheet supply apparatus 100 described in Japanese Patent Laid-Open Publication No. 2010-254462.

In the sheet supply apparatus 100, an air blowing section 102 blows air toward the upper end (the end of the z axis in the positive direction) of a stack S of sheets to float a sheet S1, which is the topmost sheet. An endless suction belt 104 with many through-holes is placed above the stack S of sheets. A chamber (not illustrated), which is placed inside the suction belt 104, uses its built-in fan to withdraw air from between the stack S of sheets and the suction belt 104 through these through-holes, and then attaches the topmost sheet S1 to the suction belt 104. The suction belt 104 is rotated by the driving force of a motor (not illustrated). Thus, the attached sheet is conveyed in the x direction to an acceptance port 108 of a conveying path 106. Then, the topmost sheet S1 passes through the conveying path 106 and is conveyed to an imaging unit (not illustrated).

The sheet supply apparatus 100 further has an image capture section 110 and a control circuit 112. The image capture section 110 captures an image of the floated sheet S1 and a sheet immediately below the sheet S1 at a position away from a side surface P1 of the stack S of sheets by a prescribed distance in the y direction. The control circuit 112 calculates a clearance between these sheets from an image captured by the image capture section 110. The control circuit 112 also adjusts the amount of air to be blown by the air blowing section 102, according to the calculated clearance between the sheets.

In the sheet supply apparatus 100, the stack S of sheets is accommodated in a case 114 of the sheet supply apparatus 100, so the interior of the sheet supply apparatus 100 is dark, making it difficult for the image capture section 110 to capture an image of sheets. Therefore, it is also difficult for the control circuit 112 to calculate a clearance between sheets according to the image captured by the image capture section 110.

SUMMARY OF THE INVENTION

A sheet supply apparatus according to a first embodiment of the present invention includes: a tray on which a stack of sheets, which is formed with a plurality of vertically stacked sheets, can be placed; an air blowing section that blows air toward the stack of sheets placed on the tray to float at least the topmost sheet; a sucking and conveying section that sucks the topmost sheet floated by the air blowing section and conveys the topmost sheet in a prescribed conveying direction, the sucking and conveying section being disposed above the tray; a first light source that emits first slit light, which is strip-shaped light having a component extending vertically, the first slit light crossing at least a first edge of a first sheet and a second edge of a second sheet below the first sheet, the first sheet and the second sheet being part of a plurality of floated sheets; an image capture section that captures an image of the first slit light emitted to the first sheet and the second sheet, the image capture section being oriented in an image capture direction that is different, in a plane parallel to the first sheet and the second sheet, from a direction in which the first slit light is emitted from the first light source; a calculating section that calculates a vertical clearance between the first sheet and the second sheet according to the image of the first slit light captured by the image capture section; and an air amount adjusting section that adjusts the amount of air to be blown by the air blowing section, according to the vertical clearance between the first sheet and the second sheet, the vertical clearance being calculated by the calculating section.

A sheet supply apparatus according to a second embodiment of the present invention includes: a tray on which a stack of sheets, which is formed with a plurality of vertically stacked sheets, can be placed; an air blowing section that blows air toward the stack of sheets placed on the tray to float at least the topmost sheet; a sucking and conveying section that sucks the topmost sheet floated by the air blowing section and conveys the topmost sheet in a prescribed conveying direction, the sucking and conveying section being disposed above the tray; a first light source that emits first light that forms an outer edge of an illumination range having a component extending vertically, the outer edge crossing a first edge of a first sheet and a second edge of a second sheet below the first sheet; an image capture section that captures an image of the outer edge crossing the first edge and the second edge, the image capture section being oriented in an image capture direction that is different, in a plane parallel to the first sheet and the second sheet, from a direction in which the first light is emitted from the first light source toward the outer edge; a calculating section that calculates a vertical clearance between the first sheet and the second sheet according to the image of the outer edge captured by the image capture section; and an air amount adjusting section that adjusts the amount of air to be blown by the air blowing section, according to the vertical clearance between the first sheet and the second sheet, the vertical clearance being calculated by the calculating section.

A sheet supply apparatus according to a third embodiment of the present invention includes: a tray on which a stack of sheets, which is formed with a plurality of vertically stacked sheets, can be placed; an air blowing section that blows air toward the stack of sheets placed on the tray to float at least the topmost sheet; a sucking and conveying section that sucks the topmost sheet floated by the air blowing section and conveys the topmost sheet in a prescribed conveying direction, the sucking and conveying section being disposed above the tray; a first light source that emits first slit light, which is strip-shaped light extending diagonally with respect to the vertical direction, the first slit light crossing a first edge of a first sheet and a second edge of a second sheet below the first sheet, the first sheet and the second sheet being part of a plurality of floated sheets; an image capture section that captures an image of the first slit light emitted to the first sheet and the second sheet; a calculating section that calculates a vertical clearance between the first sheet and the second sheet according to the image of the first slit light captured by the image capture section; and an air amount adjusting section that adjusts the amount of air to be blown by the air blowing section, according to the vertical clearance between the first sheet and the second sheet, the vertical clearance being calculated by the calculating section.

A sheet supply apparatus according to a fourth embodiment of the present invention includes: a tray on which a stack of sheets, which is formed with a plurality of vertically stacked sheets, can be placed; an air blowing section that blows air toward the stack of sheets placed on the tray to float at least the topmost sheet; a sucking and conveying section that sucks the topmost sheet floated by the air blowing section and conveys the topmost sheet in a prescribed conveying direction, the sucking and conveying section being disposed above the tray; a first light source that emits first light that forms an outer edge of an illumination range, the outer edge extending diagonally with respect to the vertical direction and crossing a first edge of a first sheet and a second edge of a second sheet below the first sheet; an image capture section that captures an image of the outer edge crossing the first edge and the second edge; a calculating section that calculates a vertical clearance between the first sheet and the second sheet according to the image of the outer edge captured by the image capture section; and an air amount adjusting section that adjusts the amount of air to be blown by the air blowing section, according to the vertical clearance between the first sheet and the second sheet, the vertical clearance being calculated by the calculating section.

An image forming apparatus according to a fifth embodiment of the present invention includes the sheet supply apparatus described above.

DETAILED DESCRIPTION OF THE PREFERRED EMBODIMENTS

Embodiments

An image forming apparatus having a sheet supply apparatus according to an embodiment of the present invention will be described below in detail with reference to the drawings.

Figure 1:
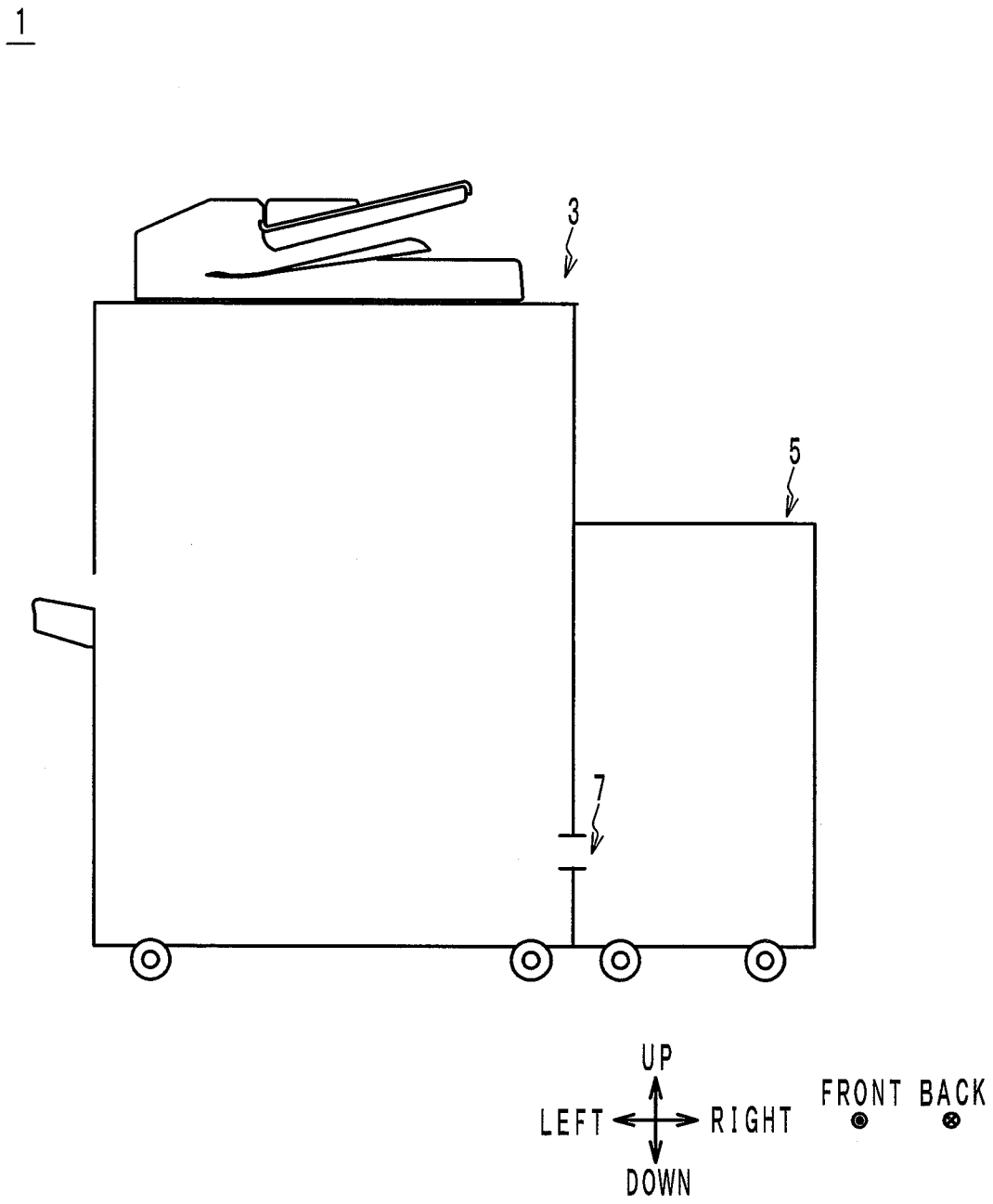
FIG. 1 illustrates the structure of an image forming apparatus having a sheet supply apparatus according to an embodiment.

First, the directions indicated in the drawings will be defined. For convenience of explanation, in this embodiment, the right and left direction on the drawing sheet of FIG. 1 is defined as the right and left directions, the front-back direction on the drawing sheet of FIG. 1 is defined as the front-back direction, and the vertical direction on the drawing sheet of FIG. 1 is defined as the vertical direction. In some structures in the drawings, subscripts a, b, c, and d may be added to the right of reference numerals. The subscript a stands for yellow (Y), b for magenta (M), c for cyan (C), and d for black (Bk). For example, an imaging section 27*a* stands for an imaging section 27 in yellow. A reference numeral without a subscript indicates that a component in any one of Y, M, C, and Bk. For example, the imaging section 27 stands for an imaging section in any one of Y, M, C, and Bk.

Structure and Operation of the Image Forming Apparatus

Figure 2:
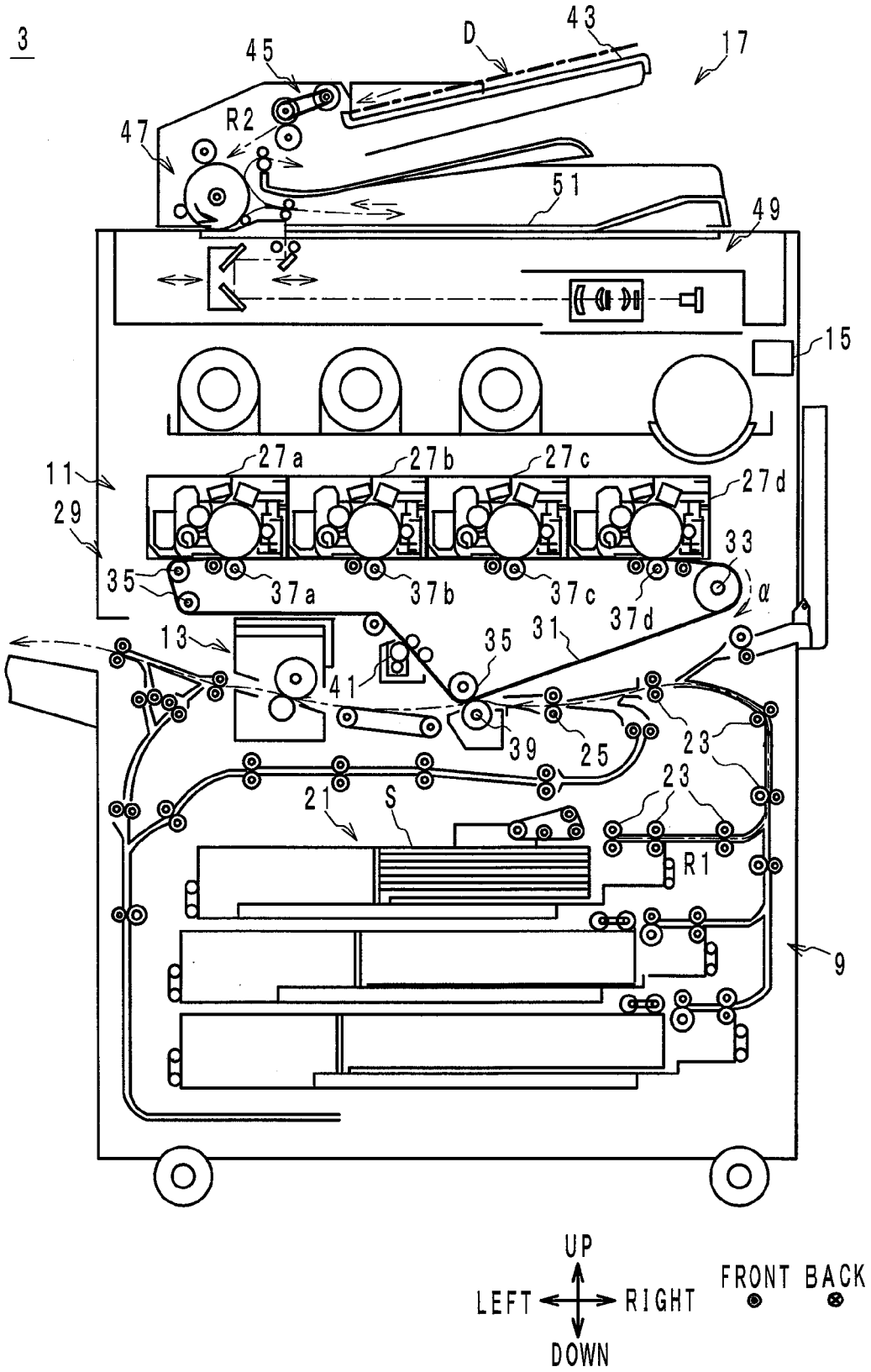
FIG. 2 illustrates the structure of the image forming apparatus in FIG. 1 in detail.
Figure 3:
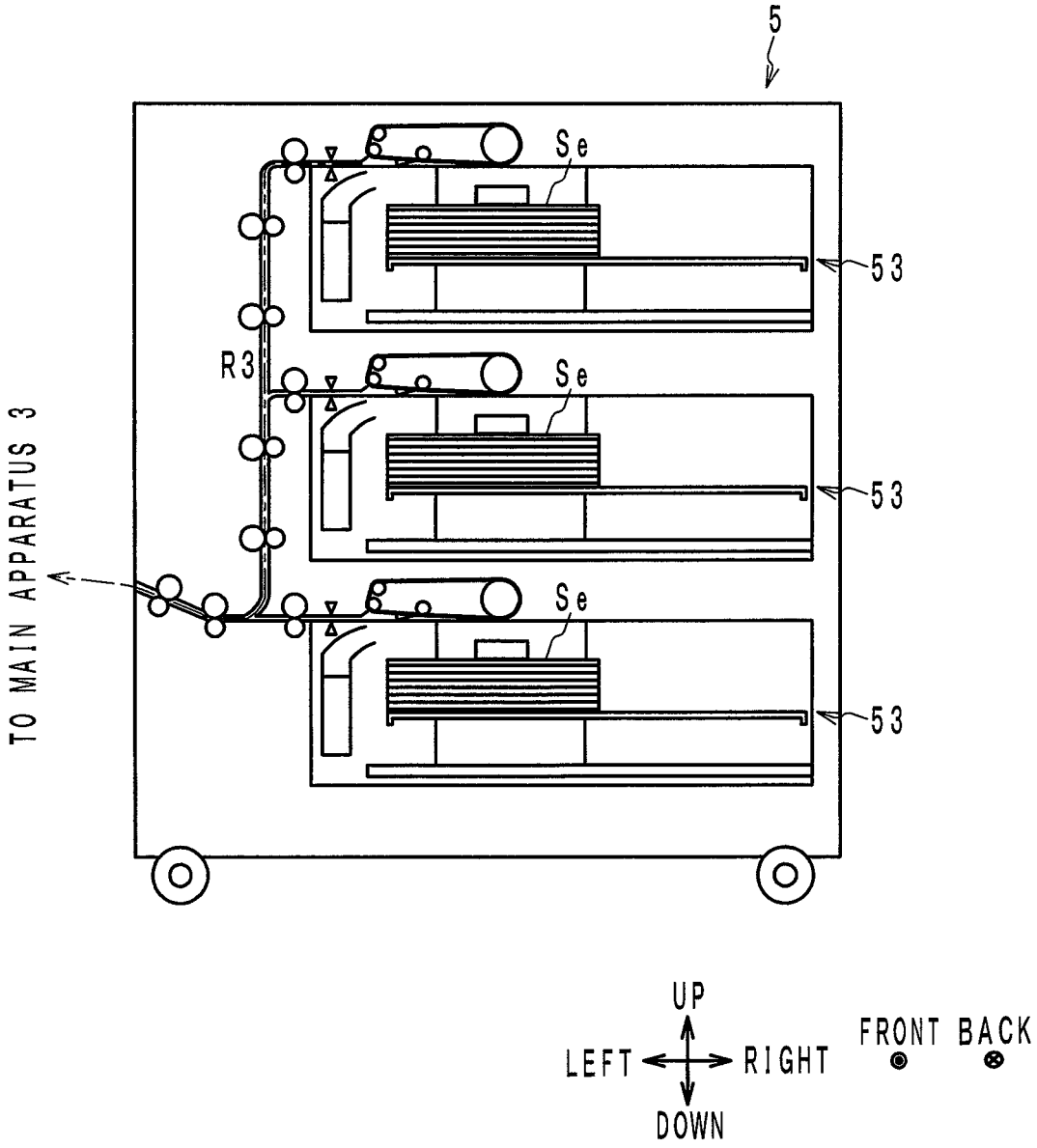
FIG. 3 illustrates the structure of the sheet supply unit in FIG. 1 in detail.

FIG. 1 illustrates the structure of an image forming apparatus 1 having a sheet supply apparatus 53 according to an embodiment. FIG. 2 illustrates the structure of the image forming apparatus 1 in FIG. 1 in detail. FIG. 3 illustrates the structure of a sheet supply unit 5 in FIG. 1 in detail.

The image forming apparatus 1 in FIG. 1 has a main apparatus 3, to which the sheet supply unit 5 is added as, for example, an option.

The main apparatus 3 is, for example, a multi-function peripheral (MFP); it has a sheet supply unit 9, an imaging unit 11, a fusing unit 13, and a control circuit 15 as illustrated in FIG. 2. An image reading unit 17 is added to the top of the main apparatus 3 as, for example, an option.

The sheet supply unit 9 generally includes a sheet supply apparatus 21, a plurality of supply roller pairs 23, and a resist roller pair 25. In the sheet supply apparatus 21, which will be described later in detail, a stack S of a plurality of sheets (paper sheets, for example) is placed. The topmost sheet is picked up from the stack S of sheets due to air pressure exerted by the sheet supply apparatus 21 and is then fed out to a first conveying path R1 indicated by the dash-dot line. The fed sheet is conveyed in the downstream direction by the supply roller pairs 23, which rotate. Then, the sheet abuts the resist roller pair 25, which is stopping, and stops. The resist roller pair 25 is then rotated by the driving force of a motor (not illustrated) at a timing controlled by a central processing unit (CPU) on the control circuit 15. The sheet then is fed out from the resist roller pair 25 toward a secondary transfer area, which will be described later, at a timing at which a combined toner image formed on an intermediate transfer belt 31, which will be described later, can be transferred to a prescribed area of the sheet.

The imaging unit 11 forms an image by an electrophotography method. In this embodiment, the imaging unit 11 forms a full-color image. Therefore, the imaging unit 11 has a tandem structure, in which, for example, imaging sections 27*a* to 27*d* respectively corresponding to Y, M, C and Bk, and a transfer section 29 are provided.

Each of the imaging sections 27*a* to 27*d* has a photosensitive drum attached so as to be rotatable. A charging section, an exposure section, a developing section, and a cleaning section are attached around the photosensitive drum.

The charging section charges the circumferential surface of the photosensitive drum in the relevant color.

The exposure section receives image data in the relevant color. The image data is transmitted from a personal computer connected to the main apparatus 3 or the image reading unit 17, which will be described later, to the CPU on the control circuit 15. The CPU creates image data in Y, M, C, and Bk from the received image data and outputs the created image data to the exposure section in the relevant colors. Each exposure section creates an optical beam modulated with the image data in the relevant color and scans the circumferential surface of the charged photosensitive drum one line at a time. Since the photosensitive drum is rotating, an electrostatic latent image in the relevant color is formed on the circumferential surface of the photosensitive drum.

The developing section develops the electrostatic latent image formed on the photosensitive drum in the relevant color with a toner, forming a toner image in the relevant color on the circumferential surface.

The transfer section 29 generally includes an endless intermediate transfer belt 31, a driving roller 33, a plurality of driven rollers 35, primary transfer rollers 37*a* to 37*d*, a secondary transfer roller 39, and a cleaning section 41.

The intermediate transfer belt 31 is passed over the driving roller 33 and the plurality of driven rollers 35. The driving roller 33 is rotated by a driving force given by a motor (not illustrated). The driven rollers 35 are rotated by following the rotation of the driving roller 33. Thus, the intermediate transfer belt 31 is rotated clockwise (direction indicated by the arrow $\alpha$).

A transfer voltage has been applied to each primary transfer roller 37. Therefore, the primary transfer roller 37 generates an electric field between the primary transfer roller 37 and the photosensitive drum in the relevant color. Due to the action of this electric field, toner images supported on all photosensitive drums are sequentially transfers to the same area on the intermediate transfer belt 31 (this process is called primary transfer). As a result, a combined toner image, in which toner images in the four colors are combined, is formed on the intermediate transfer belt 31. The combined toner image is conveyed toward the secondary transfer roller 39 due to the rotation of the intermediate transfer belt 31.

The secondary transfer roller 39 abuts the intermediate transfer belt 31, forming a secondary transfer area. The sheet fed out from the resist roller pair 25 enters the secondary transfer area. A transfer voltage has been applied to the secondary transfer roller 39. Therefore, an electric field is generated between the secondary transfer roller 39 and the intermediate transfer belt 31. Due to the action of this electric field, the toner image on the intermediate transfer belt 31 is secondarily transferred on the sheet that is passing through the secondary transfer area. The secondary transfer roller 39 and intermediate transfer belt 31 feed out the sheet, on which the toner image has been secondarily transferred, toward the downstream end of the first conveying path R1.

After the primary transfer, toner that has not been transferred to the intermediate transfer belt 31 remains on the circumferential surface of each photosensitive drum as non-transferred residual toner. In each imaging section 27, the cleaning section scrapes and collects the non-transferred residual toner from the circumferential surface of the photosensitive drum in the relevant color.

After the secondary transfer, toner that has not been transferred to the sheet remains on the circumferential surface of the intermediate transfer belt 31 as non-transferred residual toner. The cleaning section 41 scrapes and collects the non-transferred residual toner from the intermediate transfer belt 31.

The fusing unit 13 includes a heating roller and a pressurizing roller; these rollers create a fusing nip. The sheet conveyed fed out from the secondary transfer area enters this fusing nip. Due to the rotation of the heating roller and pressurizing roller, the sheet is heated and pressurized while passing through the fusing nip. Thus, the combined toner image is fused on the sheet. Then, the fusing unit 13 feeds out the sheet toward a discharge roller pair provided on the downstream side of the first conveying path R1.

When the sheet on which the combined toner image has been fused is fed from the fusing unit 13 to the discharge roller pair, it discharges the sheet to a discharge tray provided outside the main apparatus 3.

Although a process to form a full-color image has been described so far, when a monochrome image is formed, only the imaging section 27*d* in Bk is driven.

As described above, the image reading unit 17 is attached to the main apparatus 3. The image reading unit 17, which is also referred to as the automatic document feeder (ADF), generally includes a feed tray 43, a feeding section 45, a resist roller pair 47, a document reading section 49, and a discharge tray 51.

The feed tray 43 is structured so that documents D to be read can be placed. The feeding section 45 feeds out the documents D from the feed tray 43 to a second conveying path R2, indicated by arrows, one sheet at a time The resist roller pair 47 forms a resist nip. Since the resist roller pair 47 is stopping at first, the sheet fed out to the second conveying path R2 by the feeding section 45 strikes against the resist and stops. The resist roller pair 47 is then rotated at a timing controlled by the CPU on the control circuit 15 and feeds out the document D fed out to the second conveying path R2 by the feeding section 45 toward a reading position. The document D passes through the reading position and is discharged to the discharge tray 51.

The document reading section 49, which is secured immediately below the reading position, reads the document D one line at a time while the document D is passing through the reading position and creates image data. The image data is typically output to the CPU described later.

The control circuit 15 includes at least a flash memory and a main memory, besides the CPU. In the main memory, the CPU executes a program stored in the flash memory or the like to control individual components (such as the image reading unit 17 and sheet supply unit 5).

As described above, the image forming apparatus 1 has the sheet supply unit 5. The sheet supply unit 5 is disposed adjacent to the right side of the main apparatus 3 as illustrated in FIG. 1. The sheet supply unit 5 has a plurality of sheet supply apparatuses 53 placed vertically as illustrated in FIG. 3.

Each sheet supply apparatus 53 has a structure similar to the structure of the sheet supply apparatus 21, which has been described above and will be described later in detail; a stack Se of a plurality of sheets (paper sheets, for example) is placed in the sheet supply apparatus 53. The topmost sheet is picked up from the stack Se of sheets due to air pressure exerted by the sheet supply apparatus 53, which will be described later in detail, and is then fed out to a third conveying path R3 indicated by the dash-dot line. The fed sheet is conveyed through the third conveying path R3, after which the sheet is fed out through a communicating hole 7 (see FIG. 1) to the main apparatus 3. In the main apparatus 3, a conveying path (not illustrated) is provided that conveys the sheet fed out from the sheet supply apparatus 53 to the resist roller pair 25. Accordingly, an image is formed on this sheet as well as described above.

Structure and Operation of the Sheet Supply Apparatus

Figure 4:
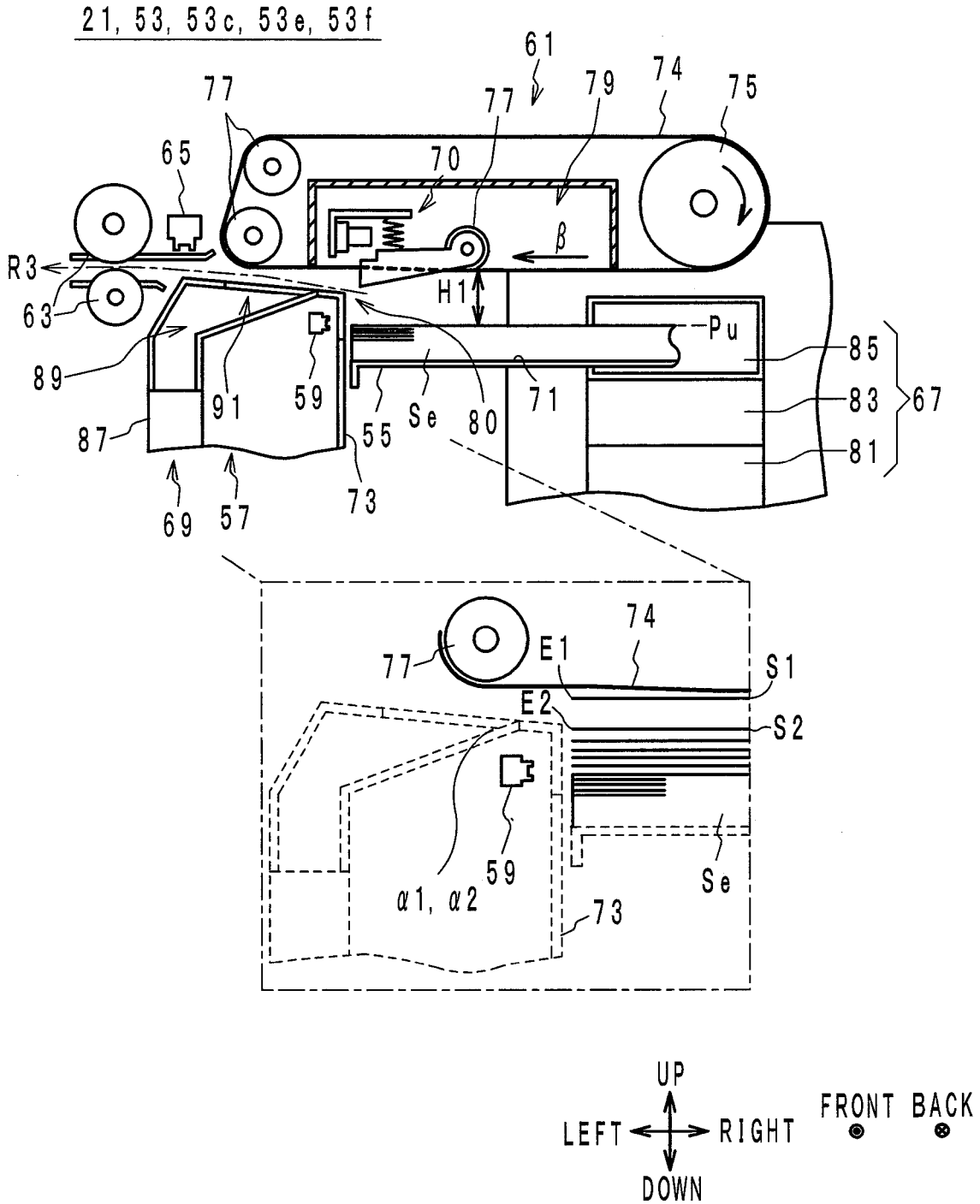
FIG. 4 is a cross sectional view illustrating the structure of the sheet supply apparatus in FIG. 3.
Figure 5:
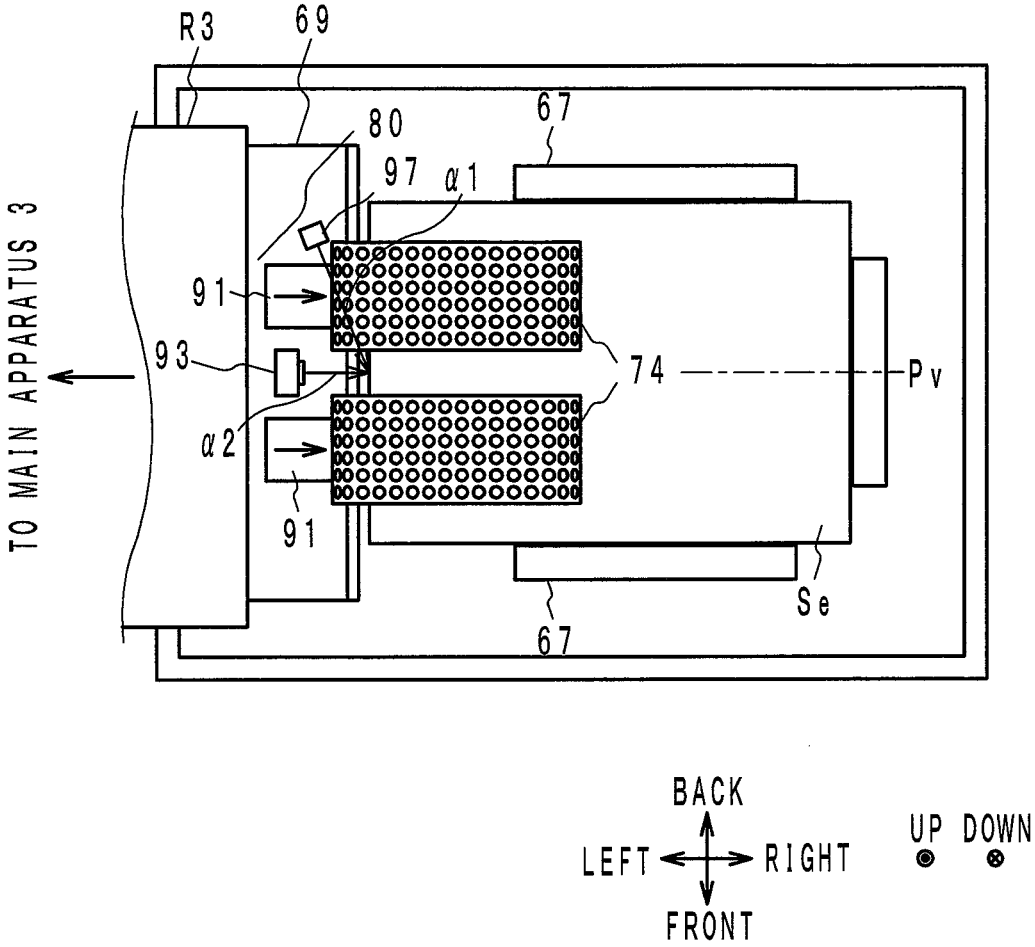
FIG. 5 is a plan view illustrating the sheet supply apparatus in FIG. 3 when viewed from above.

Next, the structure of the sheet supply apparatus 53 will be described with reference to the pertinent drawings. FIG. 4 is a cross sectional view illustrating the structure of the sheet supply apparatus 53 in FIG. 3. FIG. 5 is a plan view illustrating the sheet supply apparatus 53 in FIG. 3 when viewed from above. The sheet supply apparatus 21 has a structure similar to the structure of the sheet supply apparatus 53 as described above, so descriptions of the sheet supply apparatus 21 will be omitted.

The sheet supply apparatus 53 has an up-and-down plate 55, an abutting part 57, a limit sensor 59, a sucking and conveying mechanism 61, a conveying roller pair 63, a supply sensor 65, first blowing mechanisms 67, a second blowing mechanism 69, and a suction sensor 70.

The up-and-down plate 55 has a tray 71, which is rectangular and substantially parallel to a horizontal plane. The normal direction of the tray 71 will be referred to below as the stacking direction. The stack Se of sheets, which is a stack of a plurality of sheets placed in the stacking direction (vertical direction), is placed on the tray 71. The up-and-down plate 55 is structured so that it can be moved between a prescribed lower limit and a prescribed upper limit in the stacking direction, that is, it can be raised and lowered. A known technology can be applied to a mechanism that raises and lowers the up-and-down plate 55, so the description of the mechanism will be omitted.

The abutting part 57 has an abutting surface 73. The abutting surface 73 extends from a position along the left edge of the four edges of the tray 71 in a direction parallel to the stacking direction. An end surface on the left side (that is, left end surface) of the four surfaces of the stack Se of sheets abuts the abutting surface 73. Each sheet is fed out to the third conveying path R3, starting from the left edge of the two edges parallel to the front-back direction. Accordingly, the left end surface of the stack Se of sheets may be referred to below as the front end surface of the stack Se of sheets and the left edge of the sheet may be referred to below as the front end of the sheet.

A pair of restricting plates that restrict the position of the stack Se of sheets in the front-back direction and a restricting plate that restricts the position of the right end surface of the stack Se of sheets in the right and left direction so that the left end surface abuts the abutting surface 73 are also provided around the tray 71. However, these plates are not main parts in this application, so they will not be described in detail.

The limit sensor 59, which is typically an optical active sensor, is secured to the abutting part 57. If the topmost sheet of the stack Se of sheets is reaching the prescribed upper limit, the limit sensor 59 outputs an electric signal that indicates, for example, Hi, to the control circuit 15, which will be described later. If the topmost sheet is not reaching the upper limit, the control circuit 15 outputs an electric signal that indicates Lo.

The sucking and conveying mechanism 61 is disposed above the up-and-down plate 55 and abutting part 57. Specifically, the sucking and conveying mechanism 61 includes a plurality of suction belts (for example, two suction belts) 74, a chamber 79, a driving roller 75, and a plurality of driven rollers (for example, three driven rollers) 77.

Each suction belt 74 is an endless belt. It has many through-holes extending from its outer circumferential surface to its inner circumferential surface. Specifically, a prescribed number of through-holes (specifically, rows of through-holes) are formed in the width direction of each suction belt 74 (that is, in a direction parallel to the front-back direction). These rows of through-holes are formed over the entire circumference of each suction belt 74 with a prescribed clearance between each two rows.

The chamber 79, which is disposed inside the suction belts 74, generally includes an air suction hole, a fan, and a motor. The air suction hole is formed so as to face the inner circumferential surface of the lower side of each suction belt 74. The fan, which is accommodated in the chamber 79, is rotated by a driving force given by the motor. Thus, air between the suction belts 74 and the stack Se of sheets is inhaled into the chamber 79 through the through-holes in the suction belts 74, so the topmost sheet floated by the first blowing mechanisms 67, which will be described later, and the like is sucked to the lower end surfaces (that is, sucking surfaces) of the suction belts 74.

The driving roller 75 is disposed above the central portion of the stack Se of sheets in the right and left direction when viewed from, for example, the front side. Two driven rollers 77 are disposed above the second blowing mechanism 69 so as to be aligned substantially in the vertical direction. The positions of the driven rollers 77 in the right and left direction are offset to the left from the abutting surface 73. Between the driving roller 75 and the lower driven roller 77 (sometimes referred to below as the left driven roller 77), the remaining driven roller 77 (sometimes referred to below as the intermediate driven roller 77) is placed.

The driving roller 75 and driven rollers 77 each have a rotational shaft substantially parallel to the front-back direction. The rotation of the driving roller 75 is driven by a driving force given by a motor (not illustrated). When the driving roller 75 is rotated, the driven rollers 77 are rotated accordingly.

The two suction belts 74 are passed over the driving roller 75 and driven rollers 77 so as to be aligned in the front-back direction. Specifically, the driving roller 75 and intermediate driven roller 77 are disposed so that their upper end positions are substantially the same in the vertical direction. The intermediate driven roller 77 and left driven roller 77 are disposed so that the lower end of the left driven roller 77 is positioned slightly lower than the lower end of the intermediate driven roller 77. Thus, the suction belts 74 become substantially parallel to a horizontal plane between the driving roller 75 and the intermediate driven roller 77, and are inclined diagonally upward with respect to a horizontal plane between the intermediate driven roller 77 and the left driven roller 77. In other words, the suction belts 74 are bent at a position of the intermediate driven roller 77. The suction belts 74 of this type are rotated clockwise when the driving roller 75 is rotated. Thus, the topmost sheet sucked to the sucking surface of the suction belts 74 is conveyed to the left (that is, in the conveying direction).

The top of the third conveying path R3 is illustrated in FIGS. 4 and 5. The third conveying path R3 is generally formed with a plurality of guide members. An entrance hole 80, which the sheet enters, is formed at the top of the third conveying path R3. The entrance hole 80 is a clearance between the upper end of the abutting part 57 and the bottom of the left driven roller 77.

The conveying roller pair 63 is disposed above and below the third conveying path R3 in the vicinity of the entrance hole 80. The conveying roller pair 63 is rotated by a driving force given by a motor (not illustrated) and holds a sheet that has entered a clearance between the paired rollers, and feeds out the sheet toward the downstream side in the third conveying path R3.

The supply sensor 65, which is typically an optical active sensor, is disposed above the third conveying path R3 and between the entrance hole 80 and the conveying roller pair 63. The supply sensor 65 outputs a Hi or Lo electric signal to the control circuit 15 to indicate whether a sheet has passed through a reference position between the entrance hole 80 and the conveying roller pair 63.

With respect to the up-and-down plate 55, one first blowing mechanism 67 is disposed on the front side of the image forming apparatus 1 and another first blowing mechanism 67 is disposed on its back side. Each first blowing mechanism 67 typically includes a fan 81, a duct 83, and an outlet 85.

The fan 81 inhales surrounding air into the duct 83. In the first blowing mechanism 67 on the front side, the outlet 85 is formed in the duct 83 so as to face the vicinity of the upper end of the front end surface of the stack Se of sheets. Air is inhaled into the duct 83 of the first blowing mechanism 67 on the front side and flows in the duct 83 toward the outlet 85. The air is then expelled from the outlet 85 to the side surface of the stack Se of sheets on the front side in a range from the center at the upper end of the side surface to the vicinity of the back end.

The first blowing mechanism 67 on the back side is essentially symmetrical with the first blowing mechanism 67 on the front side with respect to a central plane Pv (see FIG. 5) of the tray 71 in the front-back direction. Therefore, air is expelled from the outlet 85 on the back side toward the upper end of the side surface of the stack Se of sheets on the back side. The side surfaces on the front side and back side are specifically surfaces of the stack Se of sheets parallel to both the direction in which the topmost sheet is conveyed and the direction in which sheets are stacked.

The air expelled from the outlet on the front side is directed to the front side surface of the stack Se of sheets, and the air expelled from the outlet on the back side is directed to the back side surface of the stack Se of sheets. The air from these outlets mainly plays a role of floating the topmost sheet of the stack Se of sheets.

The second blowing mechanism 69 is typically disposed to the left of the tray 71. Specifically, the second blowing mechanism 69 is disposed adjacent to the left side of the abutting part 57. The second blowing mechanism 69 typically includes a fan 87, a duct 89, and a plurality of outlets (for example, two outlets) 91.

The fan 87 inhales air around it into the duct 89. The duct 89 is provided so as to extend to the vicinity of the entrance hole 80 of the third conveying path R3. The duct 89 branches into two ways at an intermediate point; an outlet 91 is provided at the top of each branching duct. In this embodiment, the two outlets 91 are spaced in the front-back direction as illustrated in FIG. 5. Specifically, the outlet 91 on the front side is disposed so as to face the space immediately below the suction belt 74 on the front side and the outlet 91 on the back side is disposed so as to face the space immediately below the suction belt 74 on the back side. The air inhaled into the duct 89 flows toward the two outlets 91 and is blown from them to the right. The air blown from the outlets 91 is directed to a portion immediately below their respective suction belts 74. The air is mainly used to separate the topmost sheet from a second sheet from the top.

The suction sensor 70 includes at least an optical active sensor and a detector. The suction sensor 70 outputs a Hi or Lo electric signal to the control circuit 15 to indicate whether the topmost sheet of the stack Se of sheets has been sucked to the suction belts 74.

Figure 6:
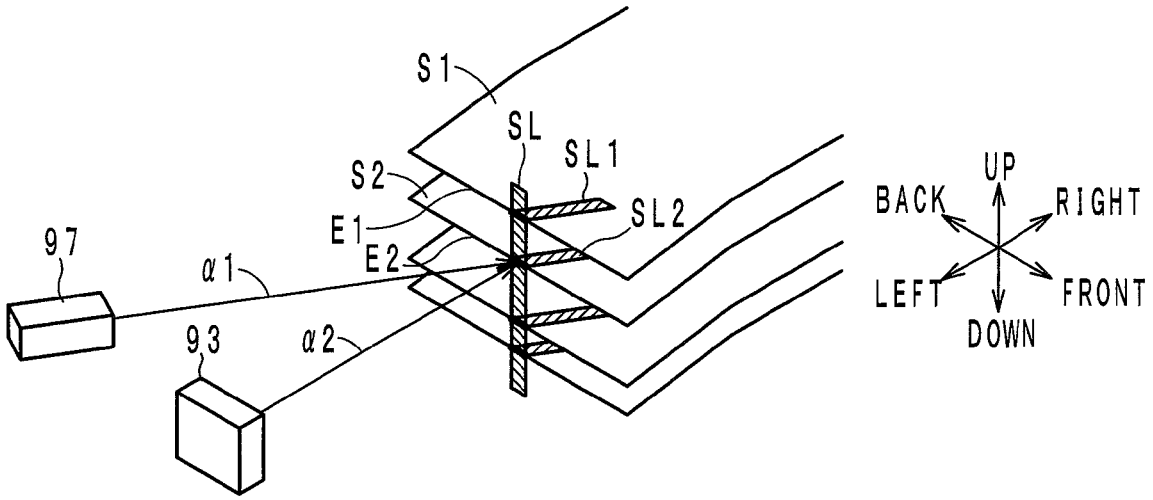
FIG. 6 is a perspective view illustrating a state of illumination by slit light SL with the front ends of sheets S1 and S2 facing down.

The sheet supply apparatus 53 further includes an image capture section (that is, a camera) 93 and a light source 97. The image capture section 93 and light source 97 will be described below with reference to the pertinent drawings. The topmost sheet will be referred to as the sheet S1, and a second sheet below it will be referred to as the sheet S2. The front end of the sheet S1 (left edge parallel to the front-back direction) will be referred to as the front end E1 (first edge), and The front end of the sheet S2 (left edge parallel to the front-back direction) will be referred to as the front end E2 (second edge). FIG. 6 is a perspective view illustrating a state of illumination by slit light SL with the front end E1 of the sheet S1 and the front end E2 of the sheet S2 facing down.

The light source 97 emits the SL toward the front end E1 of the sheet S1 and the front end E2 of the sheet S2. Specifically, the light source 97 is disposed to the left of the sheets S1 and S2 when viewed from the front side as illustrated in FIG. 4, and is disposed behind the outlet 91 on the back side when viewed from above as illustrated in FIG. 5.

Thus, the light source 97 emits slit light SL from a position to the left of and behind the centers of the front end E1 of the sheet S1 and the front end E2 of the sheet S2 in the front-back direction. The direction in which the light source 97 emits light will be defined as the direction $\alpha 1$ (exit direction). In this embodiment, the direction $\alpha 1$ is essentially parallel to a horizontal plane (that is, parallel to the sheets S1 and S2) as illustrated in FIG. 4.

Slit light SL is stripshaped light extending in the vertical direction as illustrated in FIG. 6. Slit light SL crosses the front end E1 of the sheet S1 and the front end E2 of the sheet S2. In this embodiment, slit light SL is orthogonal to the front ends E1 and E2.

The image capture section 93 is oriented in an image capture direction $\alpha 2$. When viewed from the above direction (that is, in a plane parallel to the sheets S1 and S2), the image capture direction $\alpha 2$ differs from the direction $\alpha 1$, in which the light source 97 emits slit light SL. The image capture section 93 captures an image of slit light SL emitted to the sheets S1 and S2. Specifically, the light source 97 is disposed to the left of the sheets S1 and S2 when viewed from the front side as illustrated in FIG. 4, and is disposed between the two outlets 91 when viewed from the above as illustrated in FIG. 5. In this embodiment, therefore, the image capture section 93 is oriented to the right. Since the image capture section 93 is oriented to the image capture direction $\alpha 2$, the optical axis of the image capture section 93 is oriented to the image capture direction $\alpha 2$. However, the direction $\alpha 1$ and image capture direction $\alpha 2$ do not match when viewed from above, but match when viewed from the front side. Therefore, the image capture direction $\alpha 2$ is essentially parallel to a horizontal plane (that is, parallel to the sheets S1 and S2) as illustrated in FIG. 4.

The image capture section 93 as described above typically captures an image of the front end E1 of the floated sheet S1 and the front end E2 of the sheet S2 and sends image data representing them to the control circuit 15, which will be described later.

When an image of the front end E1 of the floated sheet S1, which is the topmost sheet, and the front end E2 of the sheet S2, which is a second sheet from the top, is captured, it is preferable for the image capture section 93 to be capable of capturing an image of the sucking surfaces of the suction belts 74 while the sheet S1 is not sucked by the suction belts 74. It is also preferable for the vertical positions (that is, positions in the stacking direction) of the optical axis of the image capture section 93 and at least the outlets 91 of the second blowing mechanism 69 and the sucking surfaces of the suction belts 74 to be close to one another.

Figure 7:
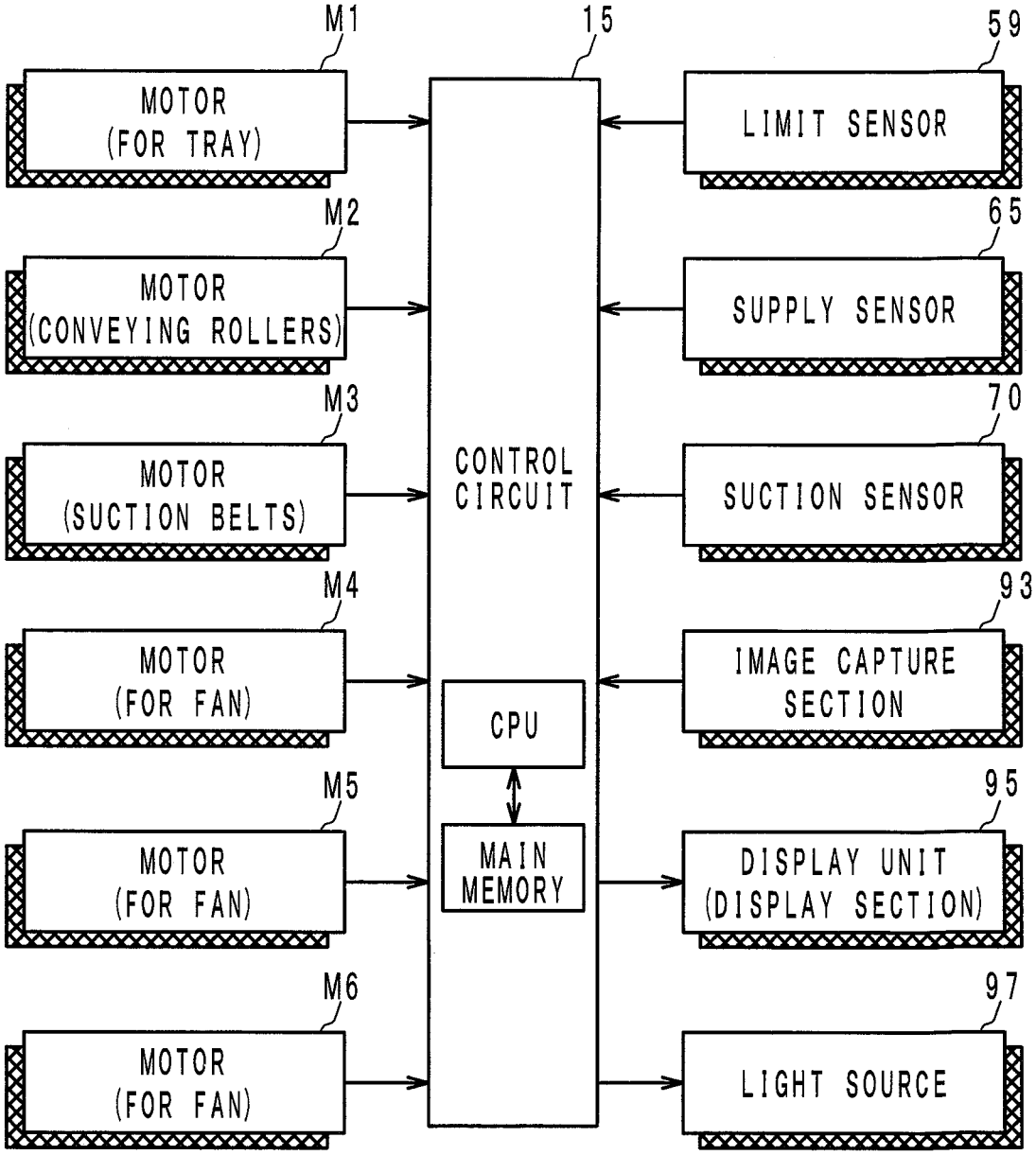
FIG. 7 is a block diagram of a control system in the sheet supply apparatus in FIG. 3.

Next, a control system in the sheet supply apparatus 53 will be described in detail with reference to the pertinent drawings. FIG. 7 is a block diagram of the control system in the sheet supply apparatus 53 in FIG. 3.

The sheet supply apparatus 53 picks up the sheet S1, which is the topmost sheet of the stack Se of sheets, due to the action of air pressure under control of the CPU and feeds out the sheet S1 to the third conveying path R3. To perform this control, necessary components of the sheet supply apparatus 53 are electrically connected to the CPU and other components included in the control circuit 15 of the main apparatus 3. Specifically, the control circuit 15 is structured so that it can receive electric signals from the limit sensor 59, supply sensor 65, and suction sensor 70, can send control signals to the light source 97, and can receive image data from the image capture section 93.

The control circuit 15 is also structured so that it can transmit control signals to a motor M1 for the tray 71, a motor M2 for the conveying roller pair 63, a motor M3 for the suction belts 74, a motor M4 for the fan 81, a motor M5 for the fan 87, and a motor M6 for the fan in the chamber 79. A display unit 95, on which various types of information can be displayed, is connected to the control circuit 15. The display unit 95 is typically attached to, for example, the main apparatus 3.

Figure 8A:
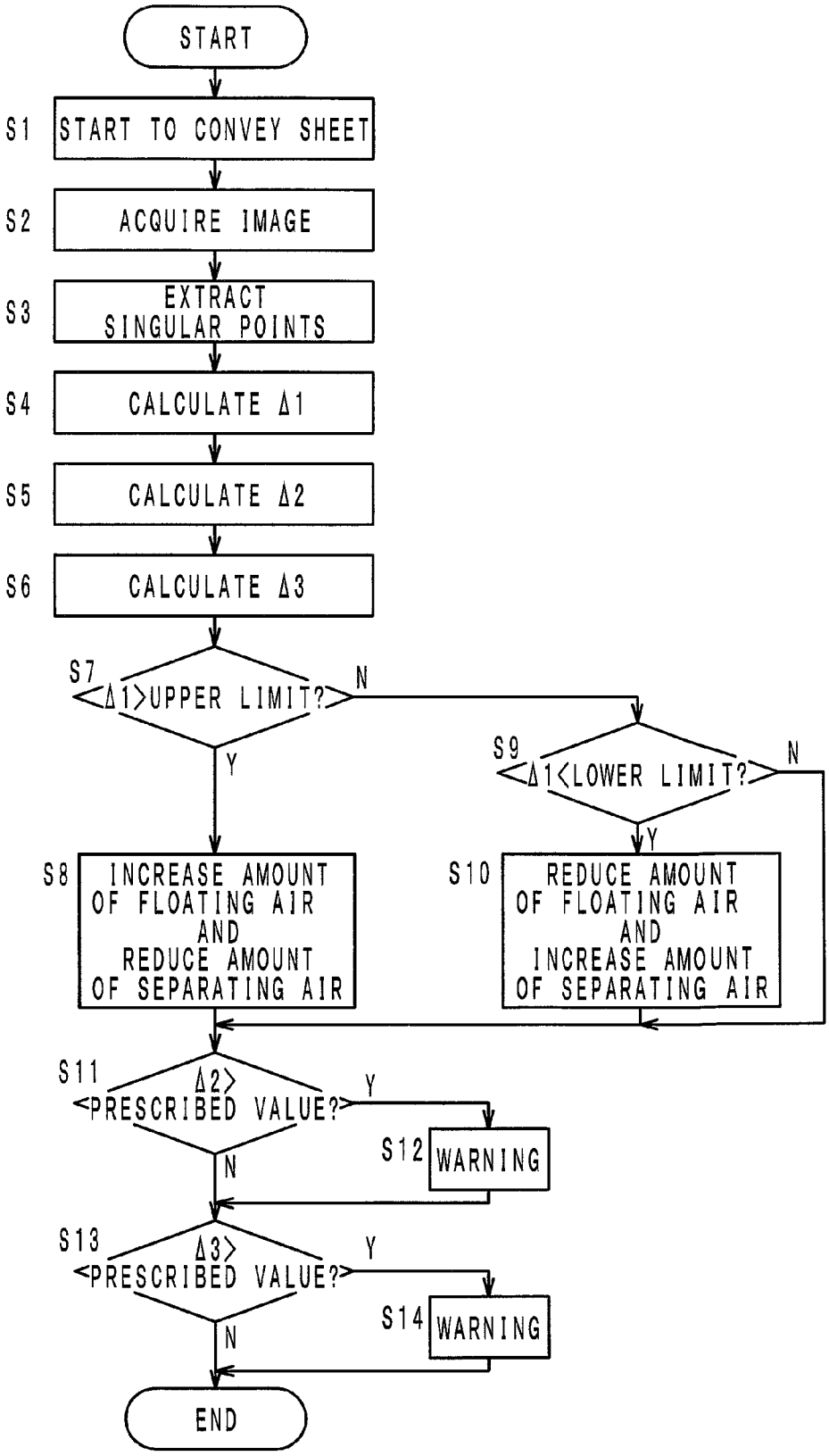
FIG. 8A is a flowchart of control performed by a control circuit in the sheet supply apparatus.

Next, the operation of the sheet supply apparatus 53 will be described with reference to the pertinent drawings. FIG. 8A is a flowchart of control performed by the control circuit 15 in the sheet supply apparatus 53.

First, the control circuit 15 starts to convey a sheet (step S1) as described below in detail. The control circuit 15 stores the size and weight of the sheet (that is, the type of the sheet) and the initial value of an optimum amount of air corresponding to the sheet type in a flash memory or the like in advance. The control circuit 15 controls the rotations of the motors M4 and M5 so that the initial value is obtained to adjust the amount of air blown from the first blowing mechanism 67 and/or the amount of air blown from the second blowing mechanism 69. The control circuit 15 also controls the rotation of the motor M6 in the chamber 79.

The limit sensor 59 outputs, to the control circuit 15, an electric signal that indicates whether the upper surface position Pu of the stack Se of sheets is at a prescribed height, that is, whether the topmost sheet S1 is at a height at which it can be sucked by the suction belts 74. The control circuit 15 controls the rotation of the motor M1 according to the electric signal obtained from the limit sensor 59 so that the upper surface position Pu is maintained at the prescribed height. By the above operation, the topmost sheet S1 is floated and the sheet starts to be conveyed.

The control circuit 15 then causes the image capture section 93 to capture an image of slit light SL emitted to the front end E1 of the topmost sheet S1 and the front end E2 of the second sheet S2 below the sheet S1 (step S2) as described below in detail. The control circuit 15 causes the light source 97 to emit slit light SL toward the front end E1 of the topmost sheet S1 and the front end E2 of the second sheet S2 below the sheet S1. Then, the image capture section 93 captures an image of slit light SL emitted to the front end E1 of the floated topmost sheet S1 and the front end E2 of the second sheet S2, which is counted from the sheet S1, creates image data representing slit light SL, and outputs the created image data to the control circuit 15.

Figure 8B:
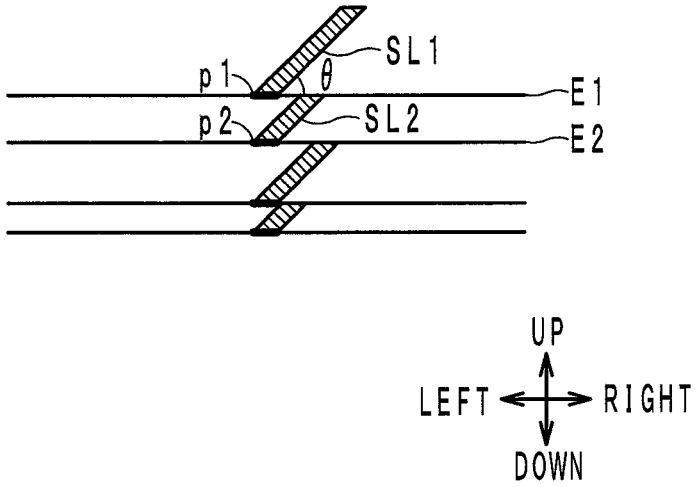
FIG. 8B illustrates a slit light SL image captured when the sheets S1 and S2 are curled so that their respective front ends E1 and E2 face downward as illustrated in FIG. 6.
Figure 9:
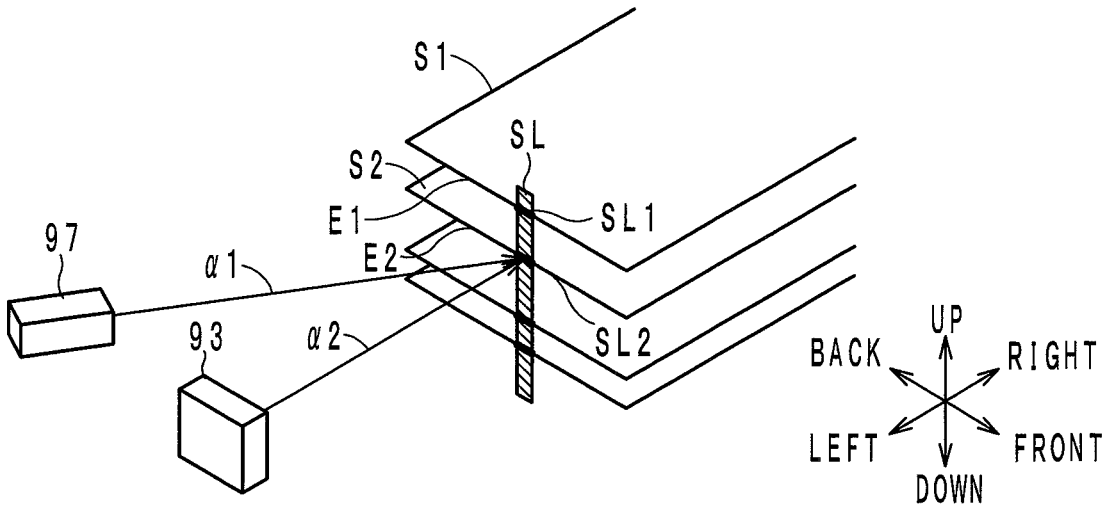
FIG. 9 is a perspective view illustrating a state of illumination by slit light SL in a state in which the sheets S1 and S2 are not curled.
Figure 10:
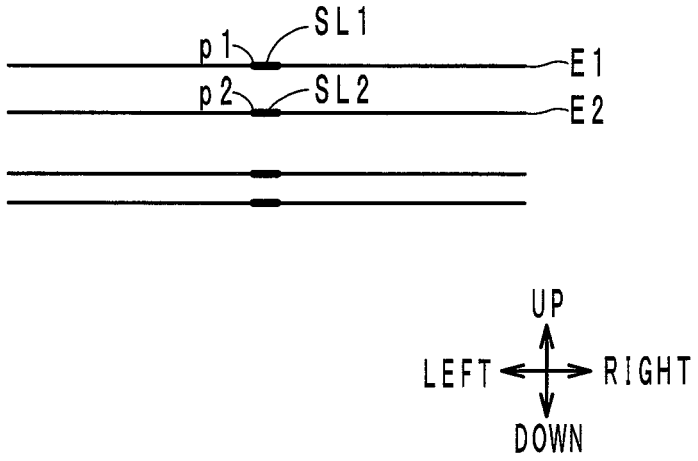
FIG. 10 illustrates a slit light SL image captured when the sheets S1 and S2 are not curled as illustrated in FIG. 9.
Figure 11:
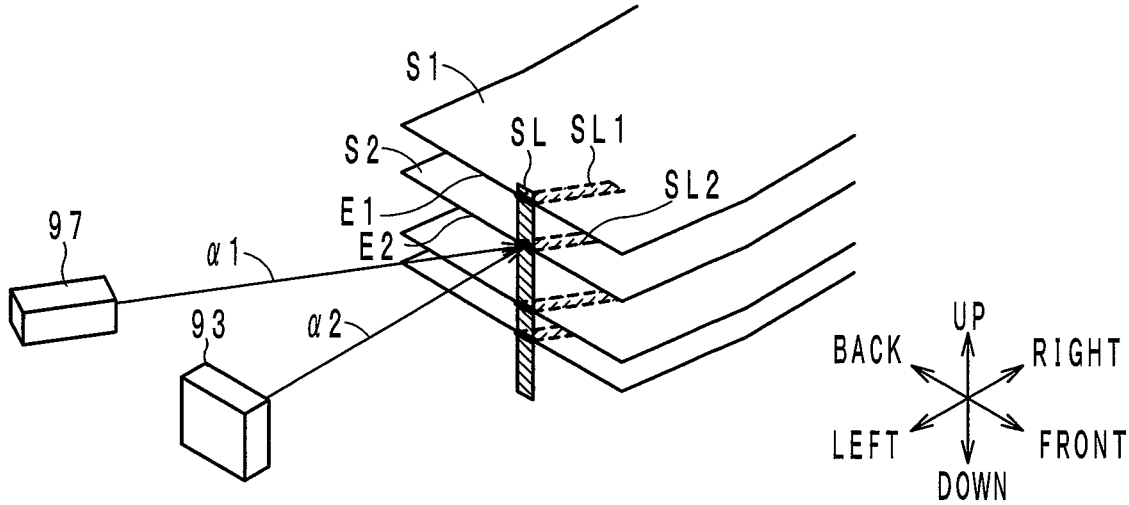
FIG. 11 a perspective view illustrating a state of illumination by slit light SL in a state in which the sheets S1 and S2 are curled so that their respective front ends E1 and E2 face upward.
Figure 12:
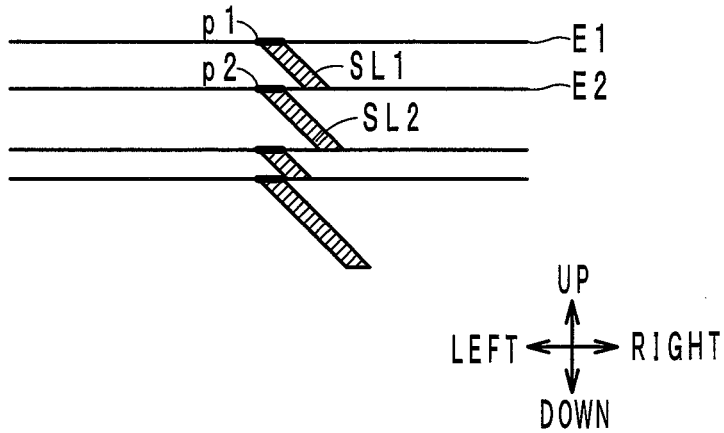
FIG. 12 illustrates a slit light SL image captured when the sheets S1 and S2 are curled so that their respective front ends E1 and E2 face upward as illustrated in FIG. 11.
Figure 13:
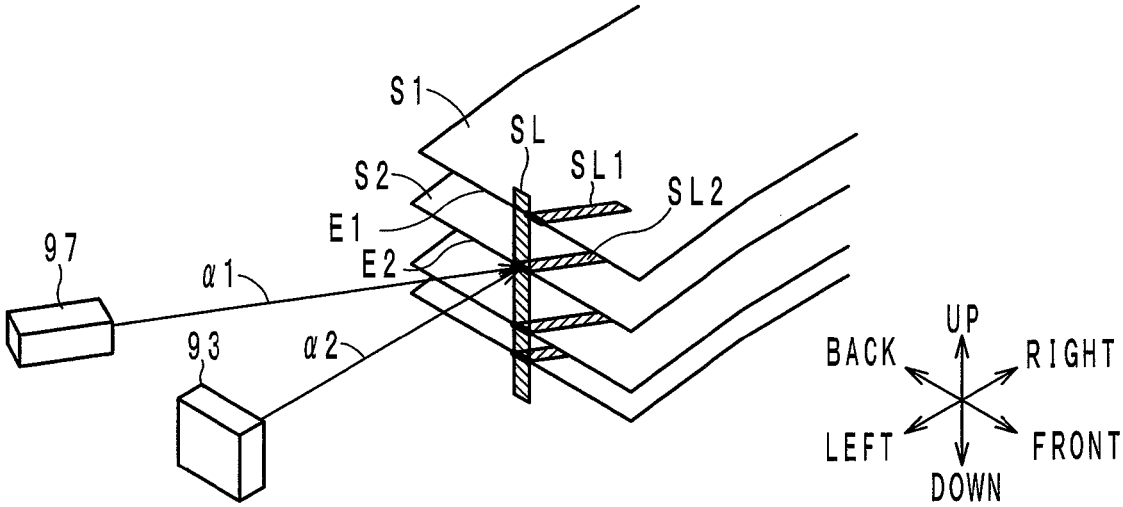
FIG. 13 is a perspective view illustrating a state of illumination by slit light SL in a state in which the sheet S1 is displaced to the right with respect to the sheet S2.
Figure 14:
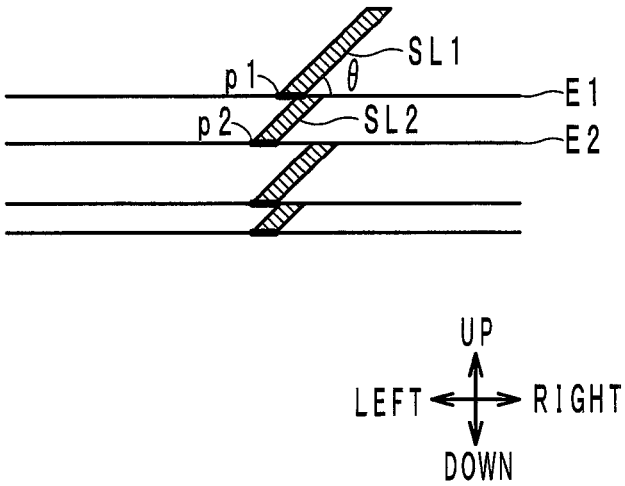
FIG. 14 illustrates a slit light SL image captured when the sheet S1 is displaced to the right with respect to the sheet S2 as illustrated in FIG. 13.
Figure 15:
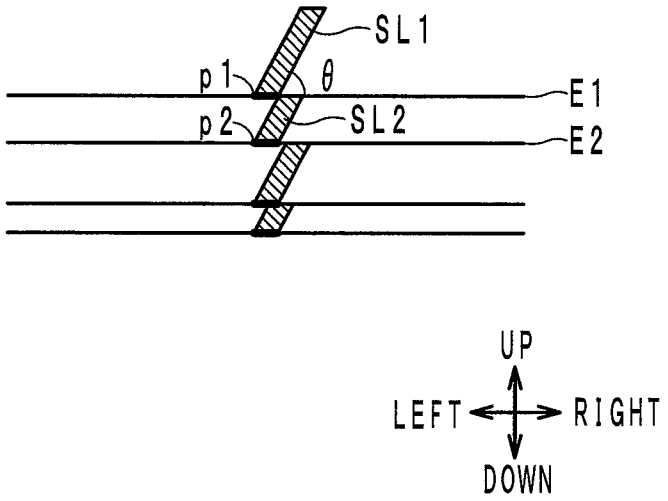
FIG. 15 illustrates a slit light SL image captured when the sheets S1 and S2 are more largely curled than in FIG. 6.

Slit light SL, an image of which is captured by the image capture section 93, will be described below with reference to the pertinent drawings. FIG. 8B illustrates a slit light SL image captured when the sheets S1 and S2 are curled so that their respective front ends E1 and E2 face downward as illustrated in FIG. 6. FIG. 9 is a perspective view illustrating a state of illumination by slit light SL in a state in which the sheets S1 and S2 are not curled. FIG. 10 illustrates a slit light SL image captured when the sheets S1 and S2 are not curled as illustrated in FIG. 9. FIG. 11 a perspective view illustrating a state of illumination by slit light SL in a state in which the sheets S1 and S2 are curled so that their respective front ends E1 and E2 face upward. FIG. 12 illustrates a slit light SL image captured when the sheets S1 and S2 are curled so that their respective front ends E1 and E2 face upward as illustrated in FIG. 11. FIG. 13 is a perspective view illustrating a state of illumination by slit light SL in a state in which the sheet S1 is displaced to the right with respect to the sheet S2. FIG. 14 illustrates a slit light SL image captured when the sheet S1 is displaced to the right with respect to the sheet S2 as illustrated in FIG. 13. In FIGS. 13 and 14, the sheets S1 and S2 are curled so that their respective front ends E1 and E2 face downward. FIG. 15 illustrates a slit light SL image captured when the sheets S1 and S2 are more largely curled than in FIG. 6.

In descriptions below, the vertical direction on the drawing sheets of FIGS. 8B, 10, 12, 14, and 15, each of which illustrates an image captured by the image capture section 93, will be defined as the vertical direction and the right and left direction on these drawing sheets will be defined as the right and left direction. The right and left direction in FIGS. 8B, 10, 12, 14, and 15 correspond to the front-back direction in FIG. 1 etc.

If the sheet S1 is curled so that its front end E1 faces downward, slit light SL forms a stripshaped illuminated area SL1, as illustrated in FIG. 6, which extends diagonally on the upper surface of the sheet S1 with respect to the front end E1, starting from the front end E1. Similarly, if the sheet S2 is curled so that its front end E2 faces downward, slit light SL forms a stripshaped illuminated area SL2, which extends diagonally on the upper surface of the sheet S2 with respect to the front end E2, starting from the front end E2. The illuminated area SL1 extends in the direction α1, in which slit light SL is emitted, starting from the front end E1 of the sheet S1. Similarly, the illuminated area SL2 extends in the direction α1, starting from the front end E2 of the sheet S2. When an image of these illuminated areas SL1 and SL2 is captured by the image capture section 93 from the left side, an image in which the illuminated areas SL1 and SL2 extend toward the upper right is obtained, as illustrated in FIG. 8B. That is, if an image in which the illuminated areas SL1 and SL2 extend toward the upper right is obtained, the control circuit 15 can determine that the sheets S1 and S2 are curled so that their respective front ends E1 and E2 face downward.

If the sheets S1 and S2 are not curled, slit light SL illuminates only the front end E1 of the sheet S1 as illustrated in FIG. 9 and does not form the illuminated area SL1 on the upper or lower surface of the sheet S1. Similarly, slit light SL illuminates only the front end E2 of the sheet S2 and does not form the illuminated area SL2 on the upper or lower surface of the sheet S2. The illuminated areas SL1 and SL2 are linear; the SL1 overlaps the front end E1 of the sheet S1 and the SL2 overlaps the front end E2 of the sheet S2, as illustrated in FIG. 9. When an image of these illuminated areas SL1 and SL2 is captured by the image capture section 93 from the left side, an image in which the illuminated areas SL1 and SL2 are linear is obtained, as illustrated in FIG. 10. That is, if an image in which the illuminated areas SL1 and SL2 are linearly formed is obtained, the control circuit 15 can determine that the sheets S1 and S2 are not curled.

If the sheet S1 is curled so that its front end E1 faces upward, slit light SL forms a stripshaped illuminated area SL1, as illustrated in FIG. 11, which extends diagonally on the lower surface of the sheet S1 with respect to the front end E1, starting from the front end E1. Similarly, if the sheet S2 is curled so that its front end E2 faces upward, slit light SL forms a stripshaped illuminated area SL2, which extends diagonally on the lower surface of the sheet S2 with respect to the front end E2, starting from the front end E2. The illuminated area SL1 extends in the direction α1, in which slit light SL is emitted, starting from the front end E1 of the sheet S1. Similarly, the illuminated area SL2 extends in the direction α1, starting from the front end E2 of the sheet S2. When an image of these illuminated areas SL1 and SL2 is captured by the image capture section 93 from the left side, an image in which the illuminated areas SL1 and SL2 extend toward the lower right is obtained, as illustrated in FIG. 12. That is, if an image in which the illuminated areas SL1 and SL2 extend toward the lower right is obtained, the control circuit 15 can determine that the sheets S1 and S2 are curled so that their respective front ends E1 and E2 face upward.

If the sheet S1 is displaced to the right with respect to the sheet S2, the front end E1 is displaced to the right with respect to the front end E2 as illustrated in FIG. 13. Since slit light SL is emitted in the direction α1 (toward the right on the front side), the illuminated area SL1 formed by slit light SL on the E1 and the upper surface of the sheet S1 is positioned closer to the front end than the illuminated area SL2 formed by slit light SL on the E2 and the upper surface of the sheet S2. When an image of these illuminated areas SL1 and SL2 is captured by the image capture section 93 from the left side, an image in which the illuminated area SL1 is displaced to the right with respect to the illuminated area SL2 is obtained, as illustrated in FIG. 14. That is, if an image in which the illuminated area SL1 is displaced to the right with respect to the illuminated area SL2 is obtained, the control circuit 15 can determine that the sheets S1 is displaced to the right with respect to the sheet S2. Although not explained here, if an image in which the illuminated area SL1 is displaced to the left with respect to the illuminated area SL2 is obtained, the control circuit 15 can similarly determine that the sheets S1 is displaced to the left with respect to the sheet S2. Although a state in which the front end E1 of the sheet S1 and the front end E2 of the sheet S2 face downward has been taken here as an example, the same is true for a state in which the sheets S1 and S2 are not curled and a state in which the front end E1 of the sheet S1 and the front end E2 of the sheet S2 face upward.

If the sheets S1 and S2 are largely curled so that their respective front ends E1 and E2 face downward, an angle θ formed by the illuminated area SL1 and the front end E1 of the sheet S1 becomes large as illustrated in FIG. 15. Then, the control circuit 15 can determine a state of the curl of the sheet S1 according to the angle θ formed by the illuminated area SL1 and the front end E1 of the sheet S1. Although a state in which the sheets S1 and S2 are curled so that their respective front ends E1 and E2 face downward has been taken here as an example, the same is true for a state in which the sheets S1 and S2 are curled so that their respective front ends E1 and E2 face upward. Accordingly, the control circuit 15 obtains various types of image data as described above, depending on the states of the sheets S1 and S2.

Figure 16:
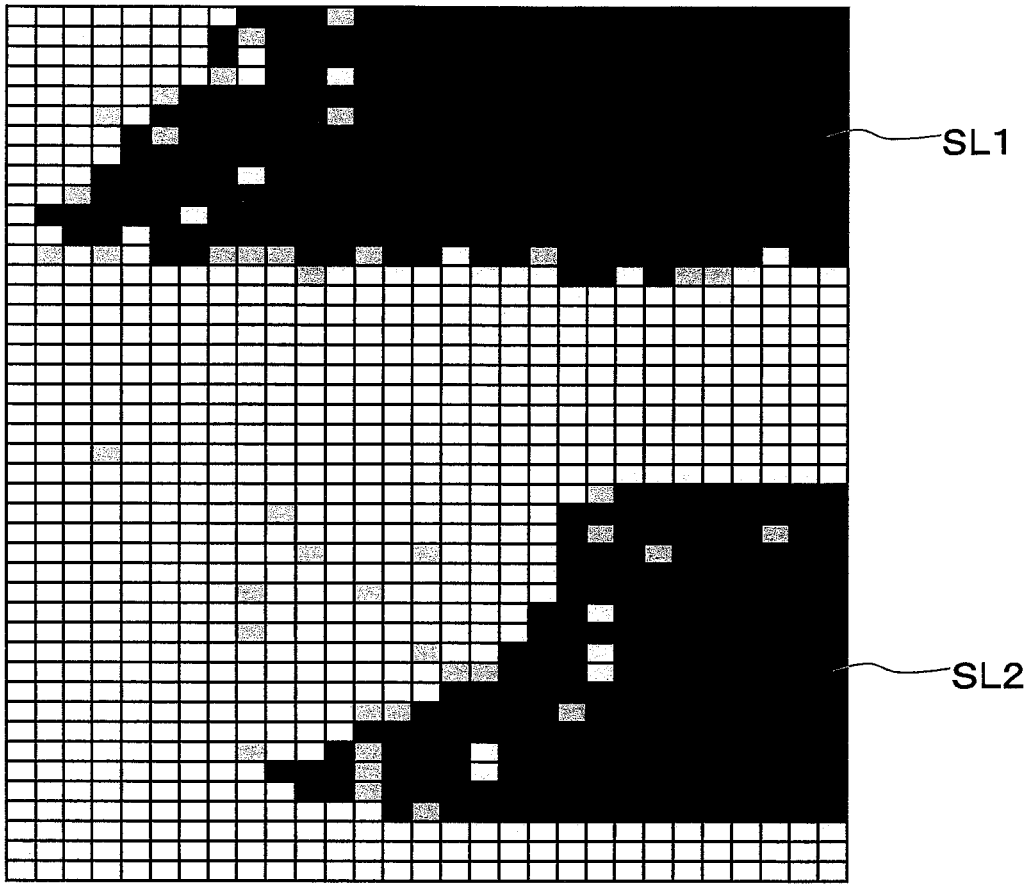
FIG. 16 illustrates image data obtained in step S2.
Figure 17:
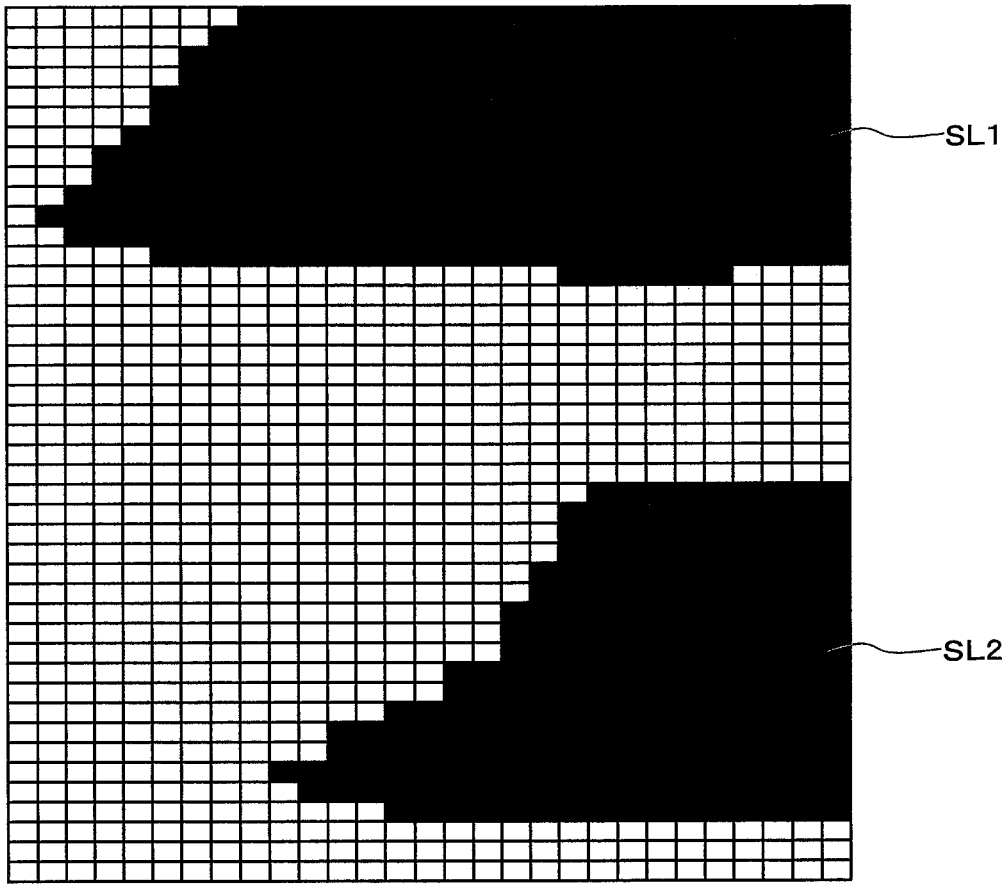
FIG. 17 illustrates image data obtained by performing binarization on the image data in FIG. 16.
Figure 18:
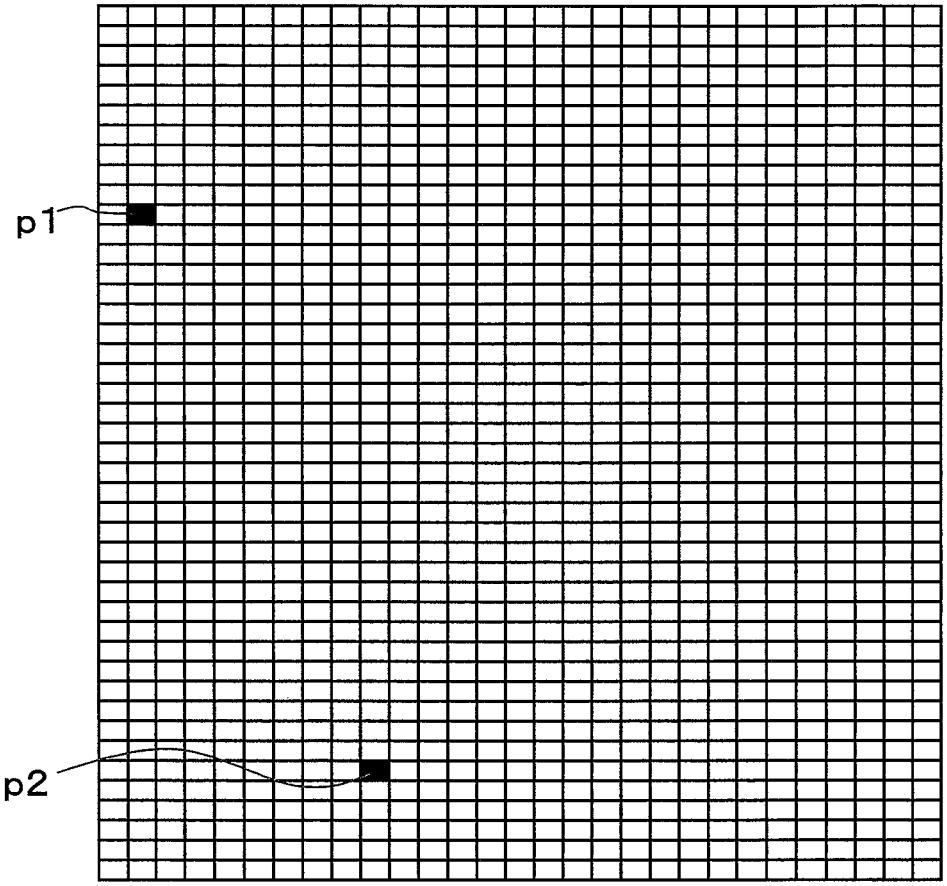
FIG. 18 illustrates image data in which singular points p1 and p2 have been extracted according to the image data in FIG. 16.

Next, the control circuit 15 extracts singular points p1 and p2 according to the illuminated areas SL1 and SL2 included in image data (step S3). How the singular points p1 and p2 are extracted will be described below with reference to the pertinent drawings. FIG. 16 illustrates the image data obtained in step S2. FIG. 17 illustrates image data obtained by performing binarization on the image data in FIG. 16. FIG. 18 illustrates image data in which the singular points p1 and p2 have been extracted according to the image data in FIG. 16.

In FIGS. 16 to 18, the vertical direction on the drawing sheet is defined as the vertical direction and the right and left direction on the drawing sheet is defined as the right and left direction. The right and left direction in FIGS. 16 to 18 correspond to the front-back direction in FIG. 1 etc.

First, the singular points p1 and p2 will be described with reference to FIG. 8B. In the illuminated area SL1, the singular point p1 is a point at the upstream end of a component in the horizontal direction of the direction in which the SL1 extends from the front end E1. In this embodiment, the illuminated area SL1 extends to the upper right, starting from the front end E1. Therefore, the component in the horizontal direction of the direction in which the illuminated area SL1 extends from the front end E1 (upper right direction) is the right direction, so the singular point p1 is a point at the left end of the illuminated area SL1. Similarly, the singular point p2 is a point at the left end of the illuminated area SL2.

The image data illustrated in FIG. 16 is image data in which each pixel is represented in 256 tones. In the image data in FIG. 16, however, each pixel is represented in three colors, white, gray and black, to simplify explanations. Sets of pixels represented in black and gray correspond to the illuminated areas SL1 and SL2. In the image data in FIG. 16, however, pixels in gray are also present at positions apart from the illuminated areas SL1 and SL2, so it is difficult to accurately extract the singular points p1 and p2.

Thus, the control circuit 15 performs image processing on image data illustrated in FIG. 16 to create image data illustrated in FIG. 17. Image processing is, for example, binarization processing. In binarization processing, the control circuit 15 calculates, for example, an average among the tone of a target pixel and the tones of pixels around the target pixel. If the calculated average is larger than or equal to a threshold, the control circuit 15 takes 1 as the tone of the target pixel. If the calculated average is smaller than the threshold, the control circuit 15 takes 0 as the tone of the target pixel. Thus, the control circuit 15 obtains the image data in FIG. 17, in which pixels with a value of 1 are represented in black and pixels with a value of 0 are represented in white.

The control circuit 15 then extracts the singular points p1 and p2 according to the illuminated areas SL1 and SL1 included in the image data in FIG. 17. Specifically, the control circuit 15 extracts the pixel at the leftmost position in the illuminated area SL1 in FIG. 17 as the singular point p1. Similarly, the control circuit 15 extracts the pixel at the leftmost position in the illuminated area SL2 in FIG. 17 as the singular point p2. Accordingly, the control circuit 15 extracts the singular points p1 and p2 in the above processing.

The control circuit 15 then calculates a time-integrated value or a time average (also referred to below as a calculated value Δ1) of a vertical clearance between the front end E1 of the sheet S1 and the front end E2 of the sheet S2 (step S4). Specifically, the control circuit 15 calculates the vertical clearance between the front end E1 of the sheet S1 and the front end E2 of the sheet S2 according to a vertical clearance between the extracted singular points p1 and p2. In this calculation, the control circuit 15 calculates the vertical clearance between the front end E1 of the sheet S1 and the front end E2 of the sheet S2 only in a prescribed time and obtains the time-integrated value or time average (calculated value Δ1) from the calculation result. The method of calculating the time-integrated value or time average is as described in Japanese Patent Laid-Open Publication No. 2010-254462, so its explanation will be omitted.

The control circuit 15 then calculates a time-integrated value or time average (also referred to below as a calculated value Δ2) of a distance in the right and left direction between the front end E1 of the sheet S1 and the front end E2 of the sheet S2 (step S5). Specifically, the control circuit 15 calculates the distance in the right and left direction (direction orthogonal to the front end E1) between the front end E1 of the sheet S1 and the front end E2 of the sheet S2 according to a displacement in the right and left direction between the extracted singular points p1 and p2. In this calculation, the control circuit 15 calculates the distance in the right and left direction between the front end E1 of the sheet S1 and the front end E2 of the sheet S2 only in a prescribed time and obtains the time-integrated value or time average (calculated value Δ2) from the calculation result. The method of calculating the time-integrated value or time average is as described in Japanese Patent Laid-Open Publication No. 2010-254462, so its explanation will be omitted.

The control circuit 15 also calculates a time-integrated value or time average (also referred to below as a calculated value Δ3) of the angle θ formed by the illuminated area SL1 and the front end E1 of the sheet S1 (step S6). The method of calculating the time-integrated value or time average is as described in Japanese Patent Laid-Open Publication No. 2010-254462, so its explanation will be omitted.

Figure 19:
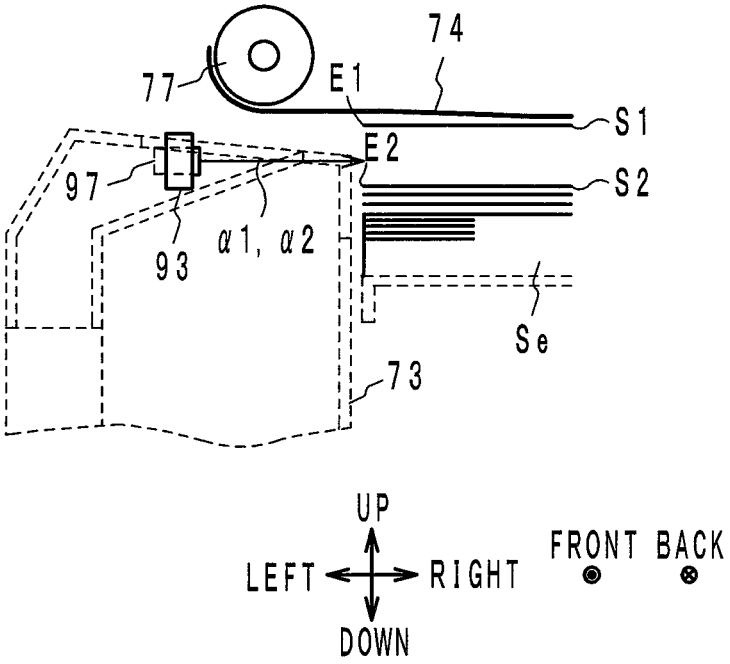
FIG. 19 is a cross sectional view illustrating the structure of the sheet supply apparatus when the sheets S1 and S2 are too apart from each other.

The control circuit 15 then determines whether the calculated value Δ1 is larger than the upper limit of a normal range (step S7). The normal range is a vertical clearance, between the front end E1 of the sheet S1 and the front end E2 of the sheet S2, up to which a jam or another problem is thought not to occur during conveyance of the sheet S1. In this processing, the control circuit 15 determines whether the sheets 51 and S2 are too apart from each other. FIG. 19 is a cross sectional view illustrating the structure of the sheet supply apparatus 53 in a case in which the sheets S1 and S2 are too apart from each other. If, as illustrated in FIG. 19, the calculated value Δ1 is larger than the upper limit of the normal range, the processing proceeds to step S8. If the calculated value Δ1 is smaller than or equal to the upper limit of the normal range, the processing proceeds to step S9.

If the calculated value Δ1 is larger than the upper limit of the normal range, the control circuit 15 makes the rotational speed of the motor M4 higher than its initial setting stored in the main memory to increase the amount of floating air blown from the fan 81 to float the sheet S1. The control circuit 15 also makes the rotational speed of the motor M5 lower than its initial setting stored in the main memory to reduce the amount of separating air blown from the fan 87 to separate the sheet S1 from the sheet S2. Then, the processing proceeds to step S11.

Figure 20:
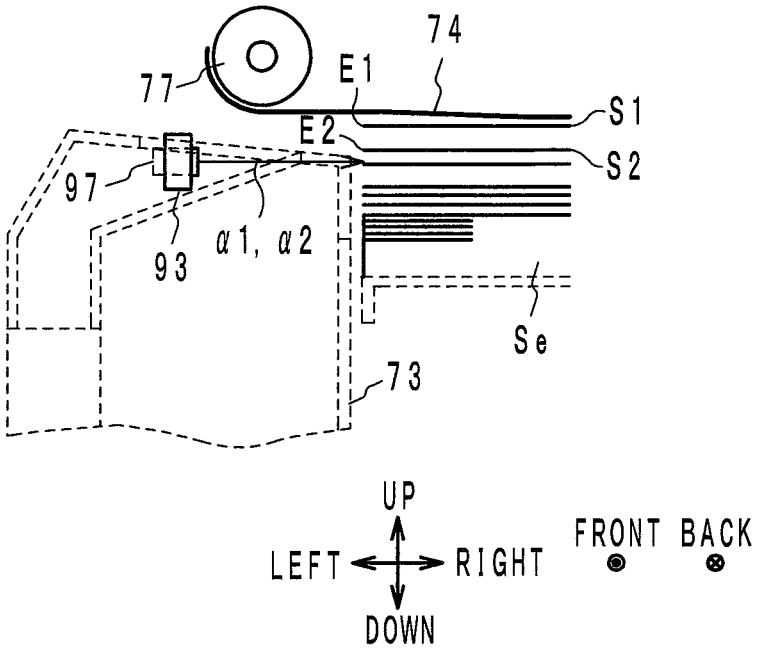
FIG. 20 is a cross sectional view of the structure of the sheet supply apparatus when the sheets S1 and S2 are too close to each other.

If the calculated value Δ1 is smaller than or equal to the upper limit of the normal range, the control circuit 15 determines whether the calculated value Δ1 is smaller than the lower limit of the normal range (step S9). In this processing, the control circuit 15 determines whether the sheets S1 and S2 are too close to each other. FIG. 20 is a cross sectional view of the structure of the sheet supply apparatus 53 in a case in which the sheets S1 and S2 are too close to each other. In steps S7 and S9, the control circuit 15 determines whether the calculated value Δ1 is within the normal range. If, as illustrated in FIG. 20, the calculated value Δ1 is smaller than the lower limit of the normal limit, the processing proceeds to step S10. If the calculated value Δ1 is larger than or equal to the lower limit of the normal range, the control circuit 15 determines that the calculated value Δ1 is within the normal range and maintains the rotational speeds of the motors M4 and M5 at their initial settings without changing the amount of floating air and the amount of separating air. Then, the processing proceeds to step S11.

If the calculated value Δ1 is smaller than the lower limit of the normal range, the control circuit 15 makes the rotational speed of the motor M4 lower than its initial setting stored in the main memory to reduce the amount of floating air blown from the fan 81. The control circuit 15 also makes the rotational speed of the motor M5 higher than its initial setting stored in the main memory to increase the amount of separating air blown from the fan 87. Then, the processing proceeds to step S11.

In step S11 above, the control circuit 15 determines whether the calculated value Δ2 is larger than its corresponding prescribed value (step S11). The prescribed value is an upper limit, of a distance in the right and left direction between the front end E1 of the sheet S1 and the front end E2 of the sheet S2, up to which a jam or another problem is thought not to occur during the conveyance of the sheet S1. If the calculated value Δ2 is larger than the prescribed value, the processing proceeds to step S12. If the calculated value Δ2 is smaller than or equal to the prescribed value, the processing proceeds to step S13.

If the calculated value Δ2 is larger than the prescribed value, the control circuit 15 displays a warning on the display unit 95 (step S12). Alternatively, the control circuit 15 may cause a speaker (not illustrated) to sound an alarm. Then, the processing proceeds to step S13.

If the calculated value Δ2 is smaller than or equal to the prescribed value, the control circuit 15 determines whether the calculated value Δ3 is larger than its corresponding prescribed value (step S13). The prescribed value is an upper limit, of an amount by which the sheet S1 is curled, up to which a jam or another problem is thought not to occur during the conveyance of the sheet S1. If the calculated value Δ3 is larger than the prescribed value, the processing proceeds to step S14. If the calculated value Δ3 is smaller than or equal to the prescribed value, the processing is terminated. After that, the control circuit 15 drives the motor M2 to operate the conveying roller pair 63 and convey the sheet S1.

If the calculated value Δ3 is larger than the prescribed value, the control circuit 15 displays a warning on the display unit 95 (step S14). Alternatively, the control circuit 15 may cause a speaker (not illustrated) to sound an alarm. Then, the processing is terminated. After that, the control circuit 15 drives the motor M2 to operate the conveying roller pair 63 and convey the sheet S1.

In steps S12 and S14, the control circuit 15 may cancels the conveyance of the sheet S1.

Advantageous Effects

With the sheet supply apparatus 53 structured as described above, light is emitted to the front end E1 of the sheet S1 and the front end E2 of the sheet S2. Thus, the image capture section 93 can capture an image of the front end E1 of the sheet S1 and the front end E2 of the sheet S2 in the sheet supply apparatus 53. This enables accurate calculation of the vertical clearance between the topmost sheet S1 and the second sheet S2 below it. Since the image capture section 93 used to capture an image of the front end E1 of the sheet S1 and the front end E2 of the sheet S2 does not need to be highly sensitive, a cost to manufacture the sheet supply apparatus 53 can be reduced.

Figure 21:
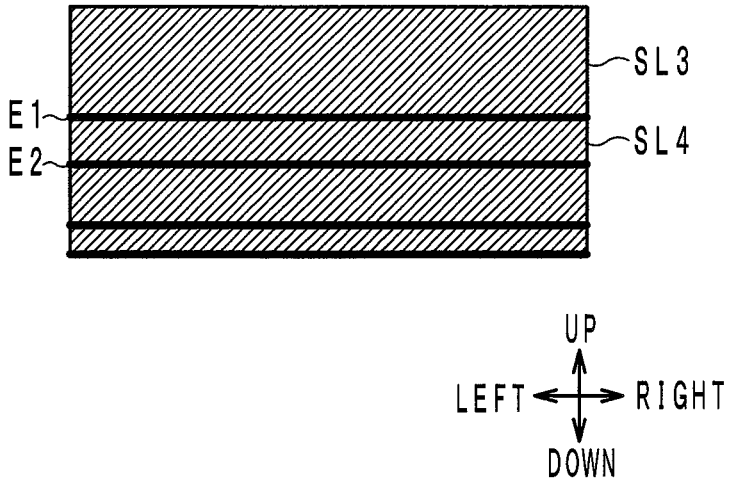
FIG. 21 illustrates an image obtained when the entire front end E1 of the sheet S1 and the entire front end E2 of the sheet S2 are illuminated by diffused light instead of slit light SL.

With the sheet supply apparatus 53, the reason described below is also true in the accurate calculation of the vertical clearance between the topmost sheet S1 and the second sheet S2 below it. FIG. 21 illustrates an image obtained when the entire front end E1 of the sheet S1 and the entire front end E2 of the sheet S2 are illuminated by diffused light instead of slit light SL. In FIG. 21, the sheets S1 and S2 are curled so that their respective front ends E1 and E2 face downward.

If the front end E1 of the sheet S1 and the front end E2 of the sheet S2 are illuminated by diffused light instead of slit light SL, the diffused light forms an illuminated area SL3 at the entire front end E1 of the sheet S1 and its upper surface adjacent to the front end E1. Similarly, the diffused light forms an illuminated area SL4 at the entire front end E2 of the sheet S2 and its upper surface adjacent to the front end E2. The illuminated area SL3 and illuminated area SL4 are adjacent to each other as illustrated in FIG. 21, so the entire sheets S1 and S2 are bright. In this case, the control circuit 15 needs to detect the front ends E1 and E2, which are brighter than the upper surfaces of the sheets S1 and S2, and to calculate the vertical clearance between the front ends E1 and E2. If a difference between the brightness at the front ends E1 and E2 and the brightness on the upper surfaces of the sheets S1 and S2 is not adequately large, it is difficult to accurately calculate the vertical clearance between the topmost sheet S1 and the second sheet S2 below it.

In view of this, the light source 97 emits slit light SL that crosses the front end E1 of the sheet S1 and the front end E2 of the sheet S2. The image capture section 93 is oriented in the image capture direction α2. When viewed from above, the image capture direction α2 differs from the direction α1, in which the light source 97 emits slit light SL. The image capture section 93 captures an image of slit light SL emitted to the sheets S1 and S2. For example, if the sheet S1 is curled so that its front end E1 faces downward, slit light SL forms the stripshaped illuminated area SL1, as illustrated in FIG. 6, which extends diagonally on the upper surface of the sheet S1 with respect to the front end E1, starting from the front end E1. Similarly, if the sheet S2 is curled so that its front end E2 faces downward, slit light SL forms the stripshaped illuminated area SL2, which extends diagonally on the upper surface of the sheet S2 with respect to the front end E2, starting from the front end E2. The illuminated area SL1 extends in the direction α1, in which slit light SL is emitted, starting from the front end E1 of the sheet S1. Similarly, the illuminated area SL2 extends in the direction α1, starting from the front end E2 of the sheet S2. When an image of these illuminated areas SL1 and SL2 is captured by the image capture section 93 oriented in the image capture direction α2 (right direction), which differs from the direction α1, an image in which the illuminated areas SL1 and SL2 extend toward the upper right is obtained, as illustrated in FIG. 8B.

Since the illuminated areas SL1 and SL2 illustrated in FIG. 8B extend diagonally, starting from the same position in the right and left direction, so they are not linked. This enables the control circuit 15 to easily extract the singular point p1 on the front end E1 in the illuminated area SL1 and the singular point p2 on the front end E2 in the illuminated area SL2. By calculating a vertical clearance between the singular points p1 and p2, the control circuit 15 can more accurately calculates the vertical clearance between the topmost sheet S1 and the second sheet S2 below it.

With the sheet supply apparatus 53, since the control circuit 15 can accurately calculate the vertical clearance between the sheet S1 and the sheet S2 below it as described above, the control circuit 15 can adjust the amount of air blown from the fans 81 and 87 according to the calculated clearance. Specifically, if the vertical clearance between the sheet S1 and the sheet S2 is larger than the upper limit of a normal range, the control circuit 15 increases the amount of floating air blown from the fan 81 and decreases the amount of separating air blown from the fan 87. Thus, the vertical clearance between the sheet S1 and the sheet S2 is narrowed and falls within the normal range. If the vertical clearance between the sheet S1 and the sheet S2 is smaller than the lower limit of the normal range, the control circuit 15 decreases the amount of floating air blown from the fan 81 and increases the amount of separating air blown from the fan 87. Thus, the vertical clearance between the sheet S1 and the sheet S2 is widened and falls within the normal range. If the vertical clearance between the sheet S1 and the sheet S2 is within the normal range, the control circuit 15 do not change the amount of floating air blown from the fan 81 or the amount of separating air blown from the fan 87. According to the above operations, the vertical clearance between the sheet S1 and the sheet S2 is maintained within the normal range.

The sheet supply apparatus 53 can also determine a state in which the sheet S1 is curled. Specifically, if the sheets S1 and S2 are curled so that their respective front ends E1 and E2 face downward, an image in which the illuminated areas SL1 and SL2 extend toward the upper right is obtained, as illustrated in FIG. 8B. If the sheet S1 is not curled, an image in which the illuminated areas SL1 and SL2 are linear is obtained, as illustrated in FIG. 10. If the sheets S1 and S2 are curled so that their respective front ends E1 and E2 face upward, an image in which the illuminated areas SL1 and SL2 extend toward the lower right is obtained, as illustrated in FIG. 12. Therefore, if illuminated areas SL1 and SL2 extend upward from the front ends E1 and E2, the control circuit 15 can determine that the sheets S1 and S2 are curled so that their respective front ends E1 and E2 face downward. If illuminated areas SL1 and SL2 extend downward from the front ends E1 and E2, the control circuit 15 can determine that the sheets S1 and S2 are curled so that their respective front ends E1 and E2 face upward.

The sheet supply apparatus 53 can make a decision on an amount by which the sheet S1 is curled. Specifically, if an amount by which the sheet S1 is curled is relatively small, the angle θ formed by the illuminated area SL1 and the front end E1 of the sheet S1 is relatively small as illustrated in FIG. 8B. If an amount by which the sheet S1 is curled is relatively large, the angle θ formed by the illuminated area SL1 and the front end E1 of the sheet S1 is relatively large as illustrated in FIG. 15. Thus, according to the size of the angle θ, the control circuit 15 can make a decision on an amount by which the sheet S1 is curled.

The sheet supply apparatus 53 can also make a decision on the displacement of the sheet S1 with respect to the sheet S2 in the right and left direction. Specifically, if the sheet S1 is displaced to the right with respect to the sheet S2, an image in which the illuminated area SL1 is displaced to the right with respect to the illuminated area SL2 is obtained as illustrated in FIG. 14. If the sheet S1 is displaced to the left with respect to the sheet S2, an image in which the illuminated area SL1 is displaced to the left with respect to the illuminated area SL2 is obtained. Thus, the control circuit 15 can determine a direction in which the sheet S1 is displaced with respect to the sheet S2 by determining a direction in which the illuminated area SL1 is displaced with respect to the illuminated area SL2.

With the sheet supply apparatus 53, the direction α1, in which the light source 97 emits slit light SL, and the image capture direction α2, in which the image capture section 93 is oriented, are essentially parallel to a horizontal direction. Therefore, if the sheet S1 is curled so that its front end E1 faces downward, the illuminated area SL1 is formed on the upper surface of the sheet S1. If the sheet S1 is curled so that its front end E1 faces upward, the illuminated area SL1 is formed on the lower surface of the sheet S1. If the sheet S1 is not curled, the illuminated area SL1 is formed only at the front end E1 of the sheet S1. Therefore, with the sheet supply apparatus 53, according to the shape of the illuminated area SL1, the control circuit 15 can easily make a decision as to whether the sheet S1 is curled.

Furthermore, the image capture direction α2, in which the image capture section 93 is oriented, is essentially parallel to a horizontal direction. This prevents the inability to capture an image of the front end E2 of the sheet S2 in a case in which the sheet S1 is curled so that its front end E1 faces downward and the front end E2 of the sheet S2 is thereby hidden below the sheet S1, and also prevents the inability to capture an image of the front end E1 of the sheet S1 in a case in which the sheet S2 is curled so that its front end E2 faces upward and the front end E1 of the sheet S1 is thereby hidden below the sheet S2.

If, with the sheet supply apparatus 53, the direction α1 and image capture direction α2 are in the same direction when viewed from above, the illuminated area SL1 and illuminated area SL2 are combined into a single stripshaped illuminated area extending vertically. In this case, it is difficult for the control circuit 15 to extract the singular point p1 in the illuminated area SL1 and the singular point p2 in the illuminated area SL2. In view of this, with the sheet supply apparatus 53, the direction α1, in which the light source 97 emits slit light SL, and the image capture direction α2, in which the image capture section 93 is oriented, differ from each other when viewed from above. This prevents the illuminated area SL1 and illuminated area SL2 are combined into one, so an image in which the starting point of the illuminated area SL1 and the starting point of the illuminated area SL2 do not match in the right and left direction as illustrated in FIG. 8B is obtained. As a result, the control circuit 15 can easily extract the singular point p1 in the illuminated area SL1 and the singular point p2 in the illuminated area SL2.

The sheet supply apparatus 53 efficiently suppresses a jam while the sheet S1 is being conveyed as described below in detail. A jam is more likely to occur when the front end E1 of the sheet S1 is caught by, for example, a guide than when the back end of the sheet S1 is caught by, for example, the guide. Therefore, the image capture section 93 and light source 97 are disposed to the left of the stack Se of sheets, that is, on the downstream side in the direction in which the sheet S1 is conveyed. Thus, the image capture section 93 captures an image of the front end E1 of the sheet S1 and the front end E2 of the sheet S2. According to the vertical clearance between the front end E1 of the sheet S1 and the front end E2 of the sheet S2, the control circuit 15 can then adjust the amount of air blown from the fans 81 and 87.

First Variation

Figure 22A:
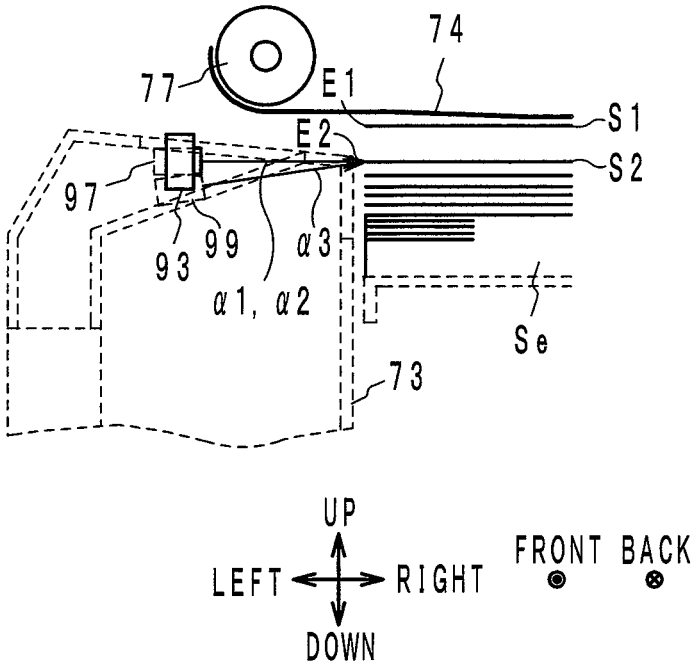
FIG. 22A is a cross sectional view illustrating the structure of a sheet supply apparatus in a first variation.
Figure 22B:
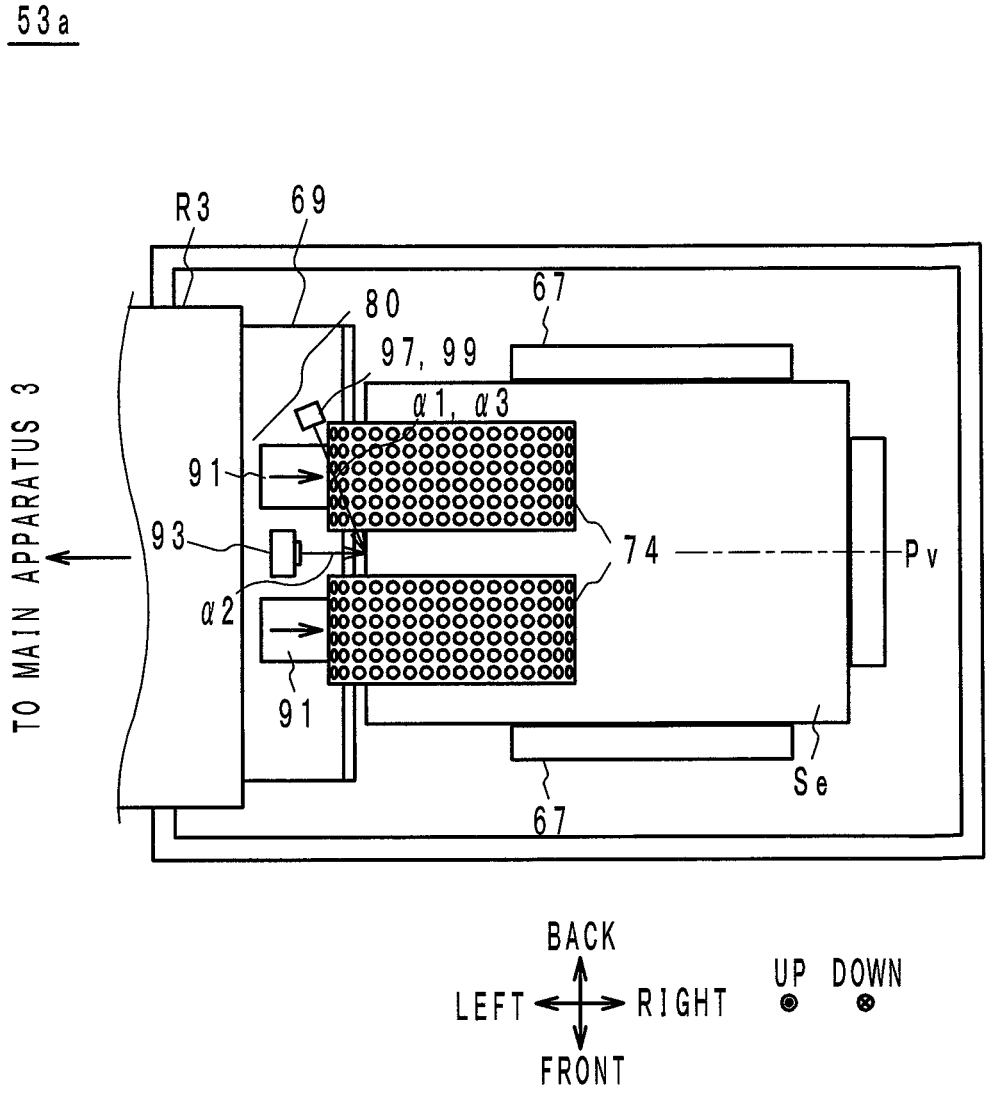
FIG. 22B is a plan view illustrating the sheet supply apparatus in the first variation.
Figure 23:
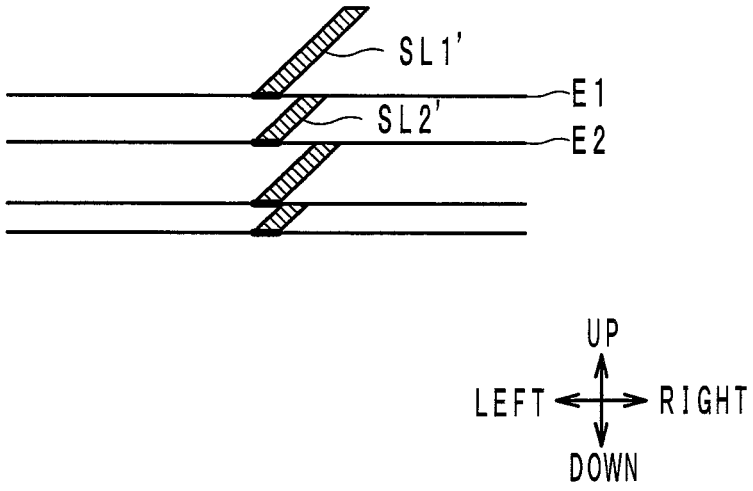
FIG. 23 illustrates a slit light SL' image captured when the sheets S1 and S2 are not curled.

Next, a sheet supply apparatus 53*a* in a first variation will be described with reference to the pertinent drawings. FIG. 22A is a cross sectional view illustrating the structure of the sheet supply apparatus 53*a* in the first variation. FIG. 22B is a plan view illustrating the sheet supply apparatus 53*a* in the first variation. FIG. 23 illustrates a slit light SL' image captured when the sheets S1 and S2 are not curled.

The sheet supply apparatus 53*a* differs from the sheet supply apparatus 53 in that it further includes a light source 99 as illustrated in FIGS. 22A and 22B. The following description of the sheet supply apparatus 53*a* will focus on this difference.

The light source 99 emits slit light SL' toward the front end E1 of the sheet S1 and the front end E2 of the sheet S2. Specifically, the light source 99 is disposed below the light source 97 as illustrated in FIG. 22A, and coincides with the light source 97 when viewed from above as illustrated in FIG. 22B.

The light source 99 emits slit light SL' from the back on the left toward the centers of the front end E1 of the sheet S1 and the front end E2 of the sheet S2 in the front-back direction.

The direction in which the light source 99 emits light will be defined below the direction α3. The direction α3 matches the direction α1 when viewed from above as illustrated in FIG. 22A and is toward the upper right when viewed from the front side as illustrated in FIG. 22B.

Slit light SL' is stripshaped light extending vertically as with slit light SL. Slit light SL' is orthogonal to the front end E1 of the sheet S1 and the front end E2 of the sheet S2.

The sheet supply apparatus 53*a* as described above can accurately calculate a vertical clearance between the sheets S1 and S2 in a state in which the sheets S1 and S2 are not curled. Specifically, in image data obtained by the image capture section 93 when the sheets S1 and S2 are not curled, the illuminated areas SL1 and SL2 are linear as illustrated in FIG. 10. If the sheets S1 and S2 are thin, therefore, it is difficult for the control circuit 15 to extract the singular points p1 and p2 according to the image data.

In view of this, the sheet supply apparatus 53*a* includes the light source 99. The light source 99 emits slit light SL' to the front end E1 of the sheet S1 and the front end E2 of the sheet S2 from diagonally below. Thus, even if the sheets S1 and S2 are not curled, slit light SL' forms, on the lower surface of the sheet S1, an illuminated area SL1' extending to the upper right, and also forms, on the lower surface of the sheet S2, an illuminated area SL2' extending to the upper right, as illustrated in FIG. 23. If the sheets S1 and S2 are not curled, therefore, the control circuit 15 stops the light source 97 from emitting slit light SL and causes the light source 99 to emit slit light SL' and the image capture section 93 to capture an image of the illuminated areas SL1' and SL2'. The control circuit 15 can then extract the singular points p1 and p2 according to the image data of the illuminated areas SL1' and SL2' image captured by the image capture section 93. Accordingly, in a state in which the sheets S1 and S2 are not curled, the sheet supply apparatus 53*a* can accurately calculate a vertical clearance between the sheet S1 and the sheet S2.

The light source 99 may be disposed above the light source 97.

Second Variation

Figure 24:
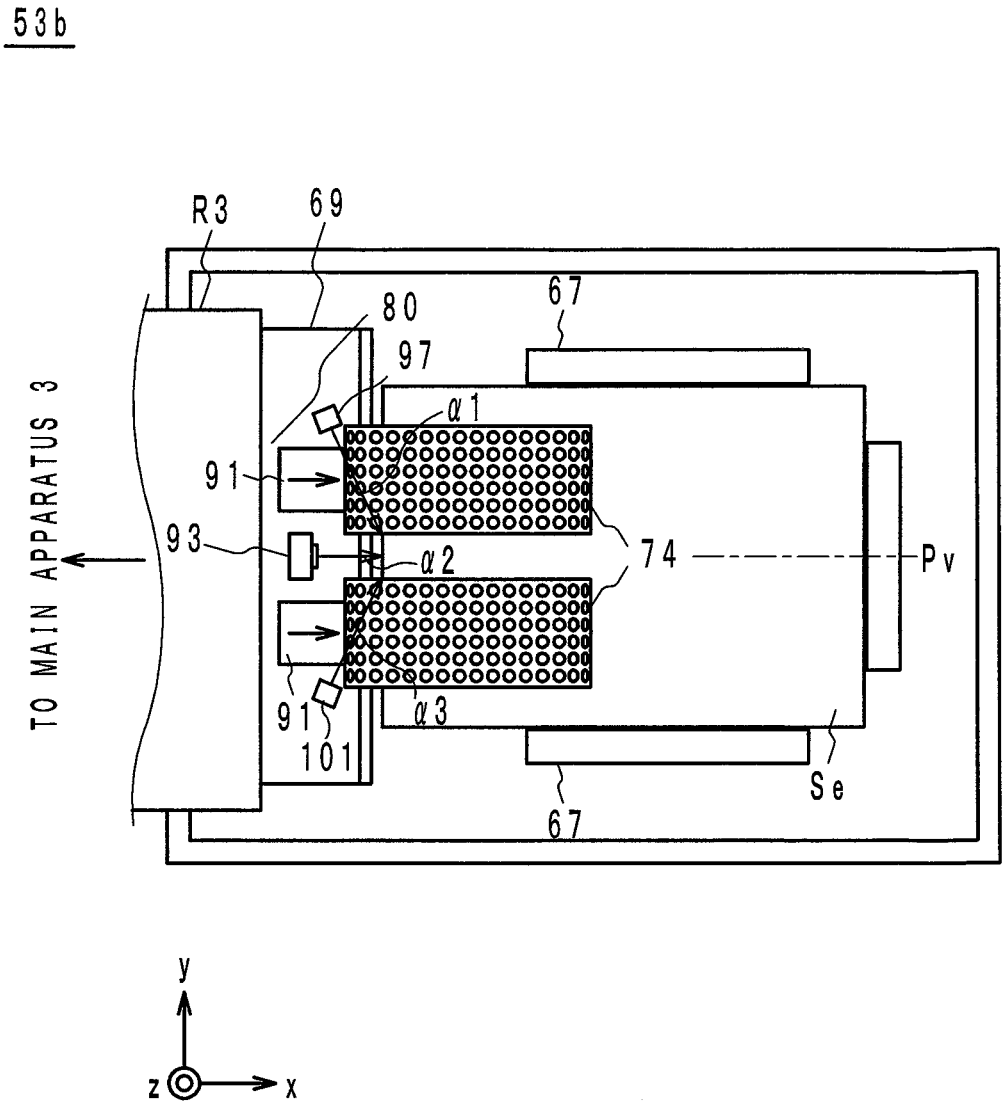
FIG. 24 is a plan view illustrating a sheet supply apparatus in a second variation.

Next, a sheet supply apparatus 53*b* in a second variation will be described with reference to the pertinent drawings. FIG. 24 is a plan view illustrating the sheet supply apparatus 53*b* in the second variation.

The sheet supply apparatus 53*b* differs from the sheet supply apparatus 53 in that it further includes a light source 101 as illustrated in FIG. 24. The following description of the sheet supply apparatus 53*b* will focus on this difference.

The light source 101 emits slit light SL" toward the front end E1 of the sheet S1 and the front end E2 of the sheet S2. Specifically, the light source 101 is disposed to the left of the sheets S1 and S2 when viewed from the y axis as illustrated in FIG. 24, and is in front of the outlet 91 when viewed from above as illustrated in FIG. 24.

Slit light slit light SL" emitted from the light source 101 illuminates positions different from positions illuminated by slit light SL emitted from the light source 97. Specifically, the light source 101 emits slit light SL" so that it illuminates positions on the front side with respect to the centers of the front end E1 of the sheet S1 and the front end E2 of the sheet S2 in the front-back direction.

The sheet supply apparatus 53*b* as described above can detect the states of the sheets S1 and S2 in more detail. This is because with the sheet supply apparatus 53*b*, slit light SL and SL" each illuminate two positions, front end E1 of the sheet S1 and front end E2 of the sheet S2. The image capture section 93 captures an image of slit light SL and SL", each of which illuminates the front end E1 of the sheet S1 and the front end E2 of the sheet S2. This enables the control circuit 15 to calculate a vertical clearance between the sheet S1 and the sheet S2 at the two places. The control circuit 15 can also detect, at two places, a state in which the sheet S1 is curled. Therefore, the control circuit 15 can detect a twisted state of the sheet S1 in which, for example, it is curled so that the front side of the front end E1 of the sheet S1 faces upward and its back side faces downward.

Third Variation

Figure 25:
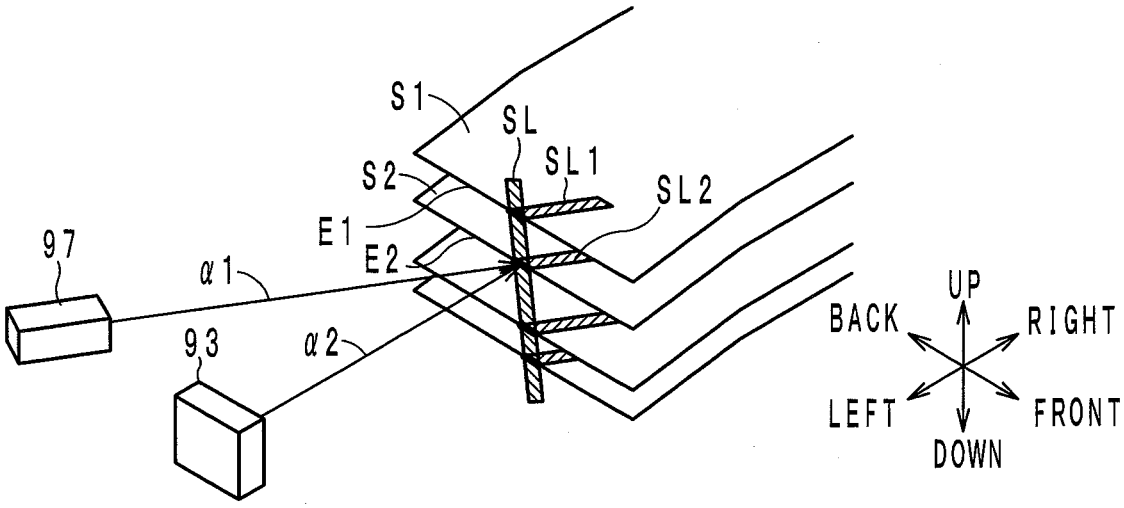
FIG. 25 is a perspective view illustrating a state of illumination by slit light SL in a state in which the sheets S1 and S2 are curled so that their respective front ends E1 and E2 face downward.
Figure 26:
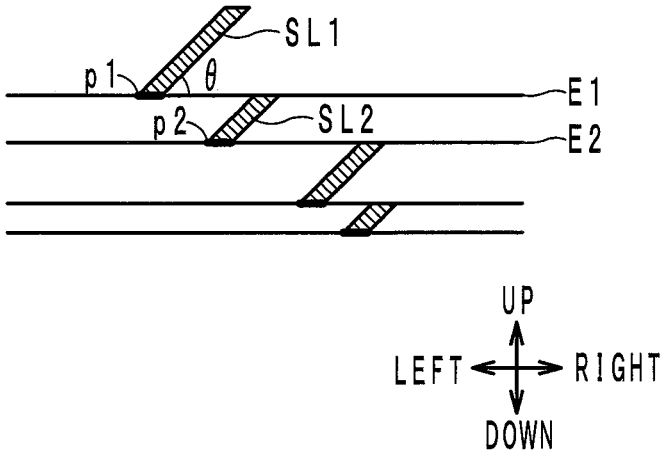
FIG. 26 illustrates a slit light SL image captured when the sheets S1 and S2 are curled so that their respective front ends E1 and E2 face downward.

Next, a sheet supply apparatus 53*c* in a third variation will be described with reference to the pertinent drawings. FIG. 25 is a perspective view illustrating a state of illumination by slit light SL in a state in which the sheets S1 and S2 are curled so that their respective front ends E1 and E2 face downward. FIG. 26 illustrates a slit light SL image captured when the sheets S1 and S2 are curled so that their respective front ends E1 and E2 face downward.

The sheet supply apparatus 53*c* differs from the sheet supply apparatus 53 in the direction in which slit light SL propagates as illustrated in FIG. 25. Slit light SL in the sheet supply apparatus 53 has propagated vertically. However, slit light SL in the sheet supply apparatus 53*c* propagates in a direction rotated counterclockwise with respect to slit light SL in the sheet supply apparatus 53 when viewed from the left side. Slit light SL does not propagate in a horizontal direction, which is orthogonal to the vertical direction. This is because if slit light SL propagates in a horizontal direction, it cannot cross the front end E1 of the sheet S1 and the front end E2 of the sheet S2. Slit light SL is only required to have a component propagating vertically.

When slit light SL is inclined with respect to the vertical direction as described above, the starting point of the illuminated area SL1 and the starting point of the illuminated area SL2 do not match in the right and left direction in an image captured by the image capture section 93 as illustrated in FIG. 26.

Fourth Variation

Figure 27:
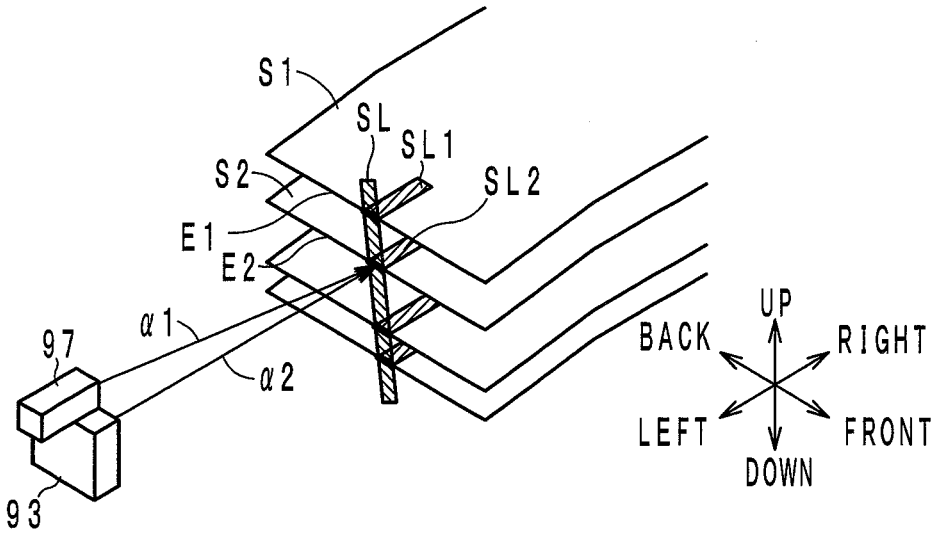
FIG. 27 is a perspective view illustrating a state of illumination by slit light SL in a state in which the sheets S1 and S2 are curled so that their respective front ends E1 and E2 face downward.
Figure 28:
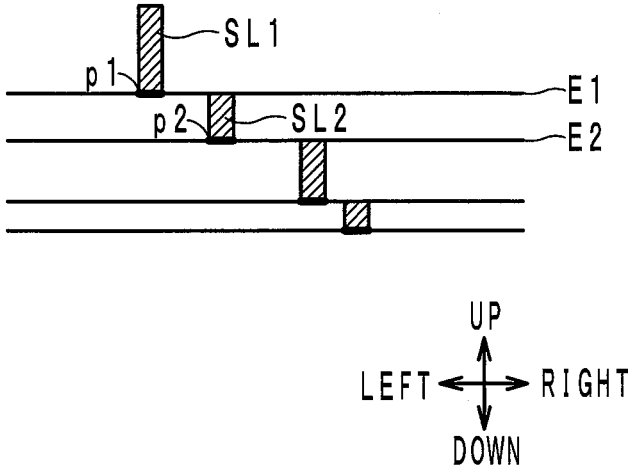
FIG. 28 illustrates a slit light SL image captured when the sheets S1 and S2 are curled so that their respective front ends E1 and E2 face downward.

Next, a sheet supply apparatus 53*d* in a fourth variation will be described with reference to the pertinent drawings. FIG. 27 is a perspective view illustrating a state of illumination by slit light SL in a state in which the sheets S1 and S2 are curled so that their respective front ends E1 and E2 face downward. FIG. 28 illustrates a slit light SL image captured when the sheets S1 and S2 are curled so that their respective front ends E1 and E2 face downward.

The sheet supply apparatus 53*d* differs from the sheet supply apparatus 53*c* in the position at which the light source 97 is disposed. The following description of the sheet supply apparatus 53*d* will focus on this difference.

As with the sheet supply apparatus 53*c*, slit light SL in the sheet supply apparatus 53*d* propagates in a direction inclined with respect to the vertical direction.

With the sheet supply apparatus 53*d*, the light source 97 overlaps the image capture section 93 when viewed from above and is on the image capture section 93. Thus, the direction α1, in which the light source 97 emits slit light SL, matches the image capture direction α2, in which the image capture section 93 is oriented, when viewed from above.

The sheet supply apparatus 53*d* as described above can calculate a vertical clearance between the sheet S1 and the sheet S2 even if the direction α1 and image capture direction α2 match when viewed from above, as described below in detail. With the sheet supply apparatus 53*d*, the direction α1 is toward the left side. Therefore, the illuminated area SL1 formed on the upper surface of the sheet S1 by slit light SL extends upward from the front end E1 of the sheet S1, and the illuminated area SL2 formed on the upper surface of the sheet S2 by slit light SL extends upward from the front end E2 of the sheet S2.

Since slit light SL is inclined with respect to the vertical direction, however, the starting point of the illuminated area SL1 and the starting point of the illuminated area SL2 do not match in the right and left direction in an image captured by the image capture section 93 as illustrated in FIG. 28. Therefore, as illustrated in FIG. 28, the illuminated areas SL1 and SL2 are not combined into a single strip shaped illuminated area extending vertically. This enables the control circuit 15 to easily extract the singular point p1 in the illuminated area SL1 and the singular point p2 in the illuminated area SL2. The sheet supply apparatus 53*d* can then calculate a vertical clearance between the sheet S1 and the sheet S2.

Fifth Variation

Figure 29:
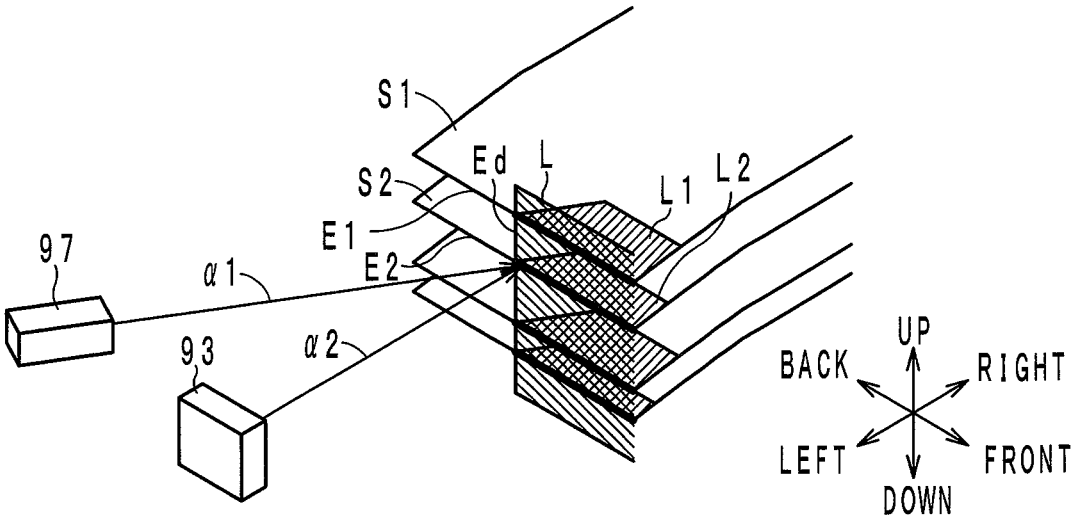
FIG. 29 is a perspective view illustrating a state of illumination by diffused light L in a state in which the sheets S1 and S2 are curled so that their respective front ends E1 and E2 face downward.
Figure 30:
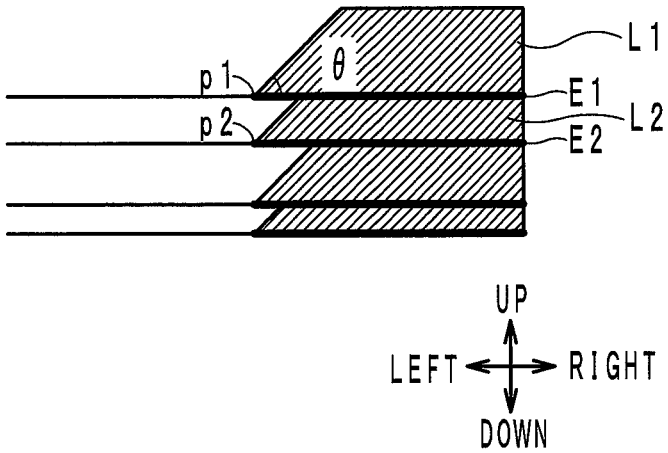
FIG. 30 illustrates a diffused light L image captured when the sheets S1 and S2 are curled so that their respective front ends E1 and E2 face downward.

Next, a sheet supply apparatus 53*e* in a fifth variation will be described with reference to the pertinent drawings. FIG. 29 is a perspective view illustrating a state of illumination by diffused light L in a state in which the sheets S1 and S2 are curled so that their respective front ends E1 and E2 face downward. FIG. 30 illustrates a diffused light L image captured when the sheets S1 and S2 are curled so that their respective front ends E1 and E2 face downward.

The sheet supply apparatus 53*e* differs from the sheet supply apparatus 53 in the structure of the light source 97 as described below in detail. The light source 97 in the sheet supply apparatus 53 has emitted slit light SL, but the light source 97 in the sheet supply apparatus 53*e* emits diffused light L that illuminates the front half of the front end E1 of the sheet S1 and the front half of the front end E2 of the sheet S2. Accordingly, the outer edge Ed of an illumination range covered by diffused light L extends vertically and crosses the front end E1 of the sheet S1 and the front end E2 of the sheet S2. Since the light source 97 as described above emits diffused light L, the back half of a surface to which diffused light L is emitted is covered with a sheet and the like. With the sheet supply apparatus 53*e*, the direction $\alpha 1$ is a direction in which diffused light L is emitted from the light source 97 toward the outer edge Ed.

With the sheet supply apparatus 53*e* structured as described above, diffused light L forms, on the upper surface of the sheet S1, the illuminated area L1 that has an outer edge extending to the upper right from the front end E1, as illustrated in FIG. 30. Diffused light L also forms, on the upper surface of the sheet S2, the illuminated area L2 that has an outer edge extending to the upper right from the front end E2. Thus, the control circuit 15 can extract the singular point p1 in the illuminated area L1 and the singular point p2 in the illuminated area L2. As with the sheet supply apparatus 53, therefore, the sheet supply apparatus 53*e* can calculate a vertical clearance between the sheet S1 and the sheet S2.

Sixth Variation

Figure 31:
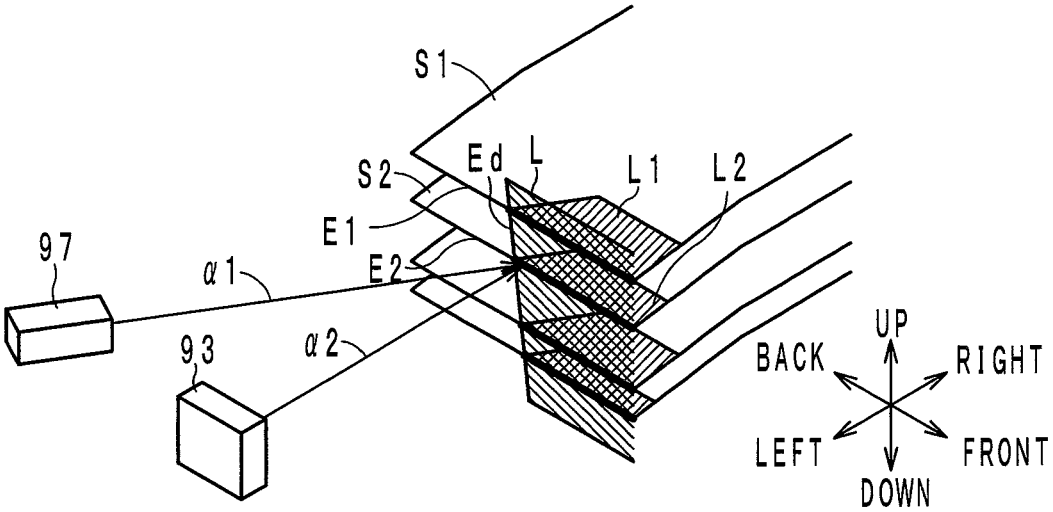
FIG. 31 is a perspective view illustrating a state of illumination by diffused light L in a state in which the sheets S1 and S2 are curled so that their respective front ends E1 and E2 face downward.
Figure 32:
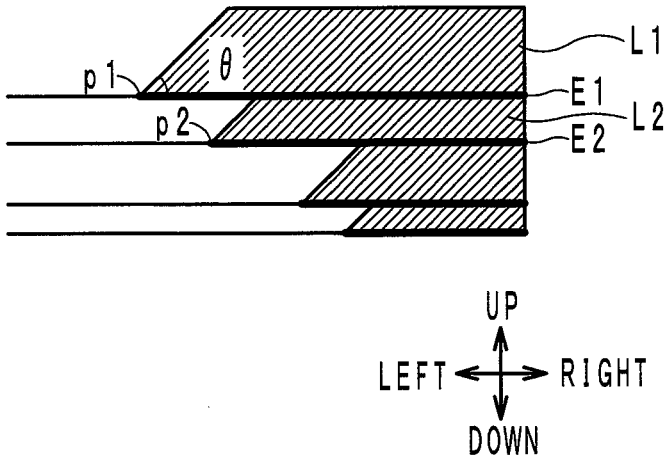
FIG. 32 illustrates a diffused light L image captured when the sheets S1 and S2 are curled so that their respective front ends E1 and E2 face downward.

Next, a sheet supply apparatus 53*f* in a sixth variation will be described with reference to the pertinent drawings. FIG. 31 is a perspective view illustrating a state of illumination by diffused light L in a state in which the sheets S1 and S2 are curled so that their respective front ends E1 and E2 face downward. FIG. 32 illustrates a diffused light L image captured when the sheets S1 and S2 are curled so that their respective front ends E1 and E2 face downward.

The sheet supply apparatus 53*f* differs from the sheet supply apparatus 53*e* in the direction in which the outer edge Ed formed by diffused light L propagates. The outer edge Ed formed by diffused light L in the sheet supply apparatus 53*e* has propagated vertically. In the sheet supply apparatus 53*c*, however, diffused light L in the sheet supply apparatus 53*f* propagates in a direction rotated counterclockwise with respect to the outer edge Ed formed by diffused light L when viewed from the left side. The outer edge Ed formed by diffused light L does not propagate in a horizontal direction, which is orthogonal to the vertical direction. This is because if the outer edge Ed formed by diffused light L propagates in a horizontal direction, the outer edge Ed cannot cross the front end E1 of the sheet S1 and the front end E2 of the sheet S2. The outer edge Ed formed by diffused light L is only required to have a component propagating vertically.

When diffused light L is inclined with respect to the vertical direction as described above, the starting point of the outer edge of the illuminated area L1 and the starting point of the outer edge of the illuminated area L2 do not match in the right and left direction in an image captured by the image capture section 93 as illustrated in FIG. 32.

Seventh Variation

Figure 33:
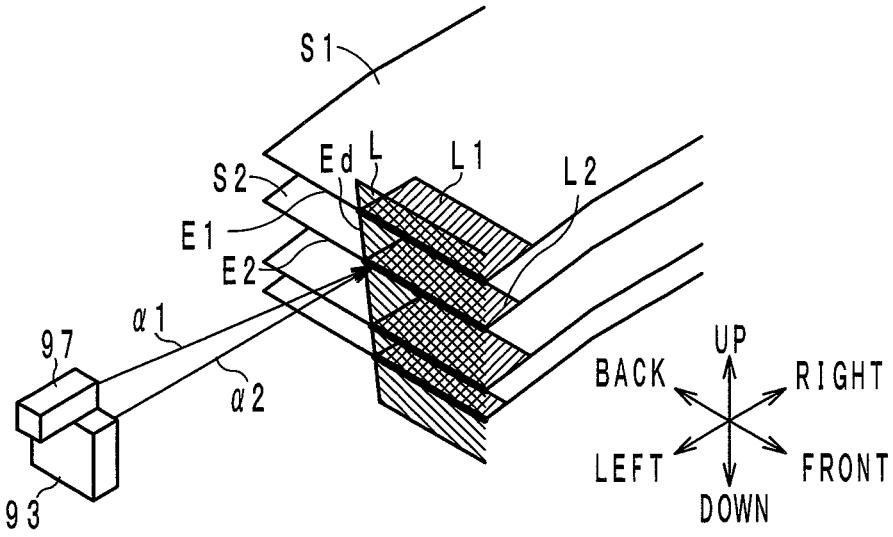
FIG. 33 is a perspective view illustrating a state of illumination by diffused light L in a state in which the sheets S1 and S2 are curled so that their respective front ends E1 and E2 face downward.
Figure 34:
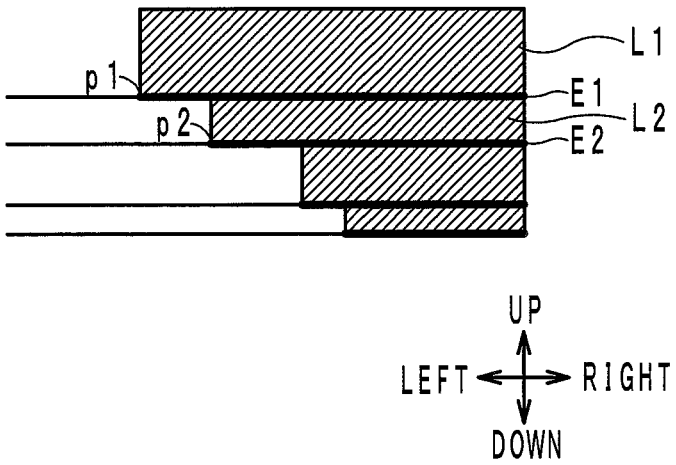
FIG. 34 illustrates a diffused light L image captured when the sheets S1 and S2 are curled so that their respective front ends E1 and E2 face downward.
Figure 35:
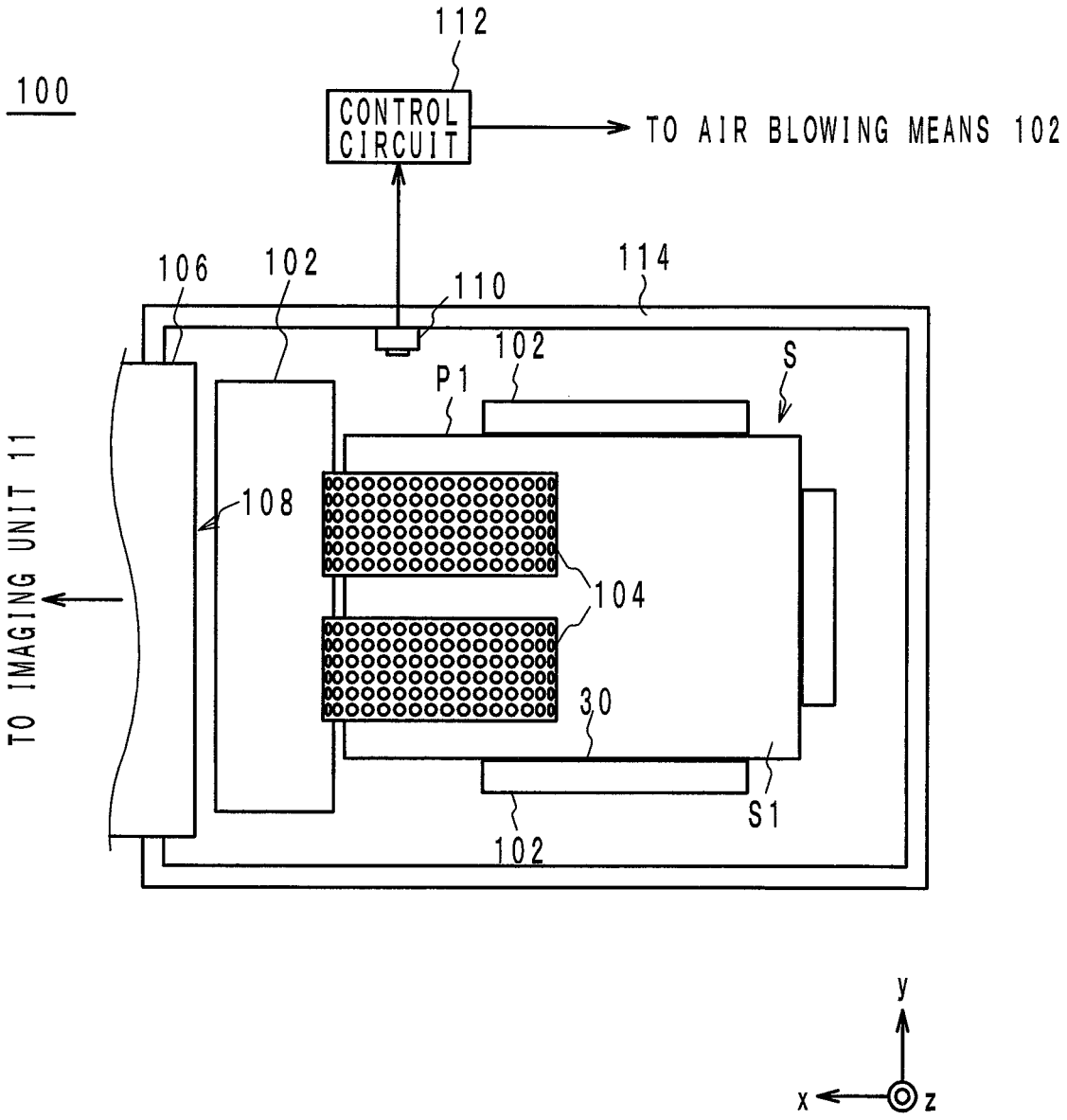
FIG. 35 illustrates the structure of the sheet supply apparatus described in Japanese Patent Laid-Open Publication No. 2010-254462.

Next, a sheet supply apparatus 53*g* in a seventh variation will be described with reference to the pertinent drawings. FIG. 33 is a perspective view illustrating a state of illumination by diffused light L in a state in which the sheets S1 and S2 are curled so that their respective front ends E1 and E2 face downward. FIG. 34 illustrates a diffused light L image captured when the sheets S1 and S2 are curled so that their respective front ends E1 and E2 face downward.

The sheet supply apparatus 53*g* differs from the sheet supply apparatus 53*f* in the position at which the light source 97 is disposed. The following description of the sheet supply apparatus 53*g* will focus on this difference.

As with the sheet supply apparatus 53*f*, the outer edge Ed formed by diffused light L in the sheet supply apparatus 53*g* propagates in a direction inclined with respect to the vertical direction.

With the sheet supply apparatus 53*g*, the light source 97 overlaps the image capture section 93 when viewed from above and is placed on the image capture section 93. Thus, the direction $\alpha 1$ from the light source 97 toward the outer edge Ed formed by diffused light L matches the image capture direction $\alpha 2$, in which the image capture section 93 is oriented, when viewed from above.

The sheet supply apparatus 53*g* as described above can calculate a vertical clearance between the sheet S1 and the sheet S2 even if the direction $\alpha 1$ and image capture direction $\alpha 2$ match when viewed from above, as described below in detail. With the sheet supply apparatus 53*g*, the direction $\alpha 1$ is toward the right side. Therefore, the outer edge of illuminated area L1 formed on the upper surface of the sheet S1 by diffused light L extends upward from the front end E1 of the sheet S1, and the outer edge of the illuminated area L2 formed on the upper surface of the sheet S2 by diffused light L extends upward from the front end E2 of the sheet S2.

Since the outer edge Ed formed by diffused light L is inclined with respect to the vertical direction, however, the outer edge of the illuminated area L1 and the outer edge of the illuminated area L2 do not match in the right and left direction in an image captured by the image capture section 93 as illustrated in FIG. 34. Therefore, as illustrated in FIG. 34, the outer edges of the illuminated areas L1 and L2 are not combined into a single line that extends vertically. This enables the control circuit 15 to easily extract the singular point p1 in the illuminated area L1 and the singular point p2 in the illuminated area L2. The sheet supply apparatus 53*g* can then calculate a vertical clearance between the sheet S1 and the sheet S2.

Other Embodiments

The sheet supply apparatus in the present invention is not limited to the sheet supply apparatuses 53 and 53*a* to 53*g*; it can be modified without departing from the intended scope of the present invention.

Any combination of the structures of the sheet supply apparatuses 53 and 53*a* to 53*g* can be used.

In the sheet supply apparatuses 53 and 53*a* to 53*g*, the image capture section 93 may be disposed in front of or behind sheets.

The light source 97 may emit slit light SL in the right and left direction, and the image capture section 93 may be oriented to the right or left on the front side and may capture an image of the illuminated areas SL1 and SL2 formed by slit light SL.

The light source 97 emits slit light SL so as to illuminate the centers of the front end E1 of the sheet S1 and the front end E2 of the sheet S2 in the front-back direction. This structure in which slit light SL illuminates the front ends E1 and E2 in the front-back direction is preferably applied to the sheet supply apparatus 53 that includes the suction belt 74 extending in the right and left direction at the center of the front-back direction of the sheet S1. This is because when the sheet S1 is sucked by the suction belts 74, the center of the front end E1 in the front-back direction is sucked by the suction belt 74, preventing the sheet from easily fluttering. However, slit light SL may illuminate a portion other than the centers of the front end E1 of the sheet S1 and the front end E2 of the sheet S2 in the front-back direction. A structure in which slit light SL illuminates a portion other than the centers of the front end E1 of the sheet S1 and the front end E2 of the sheet S2 in the front-back direction is preferably applied to the sheet supply apparatus 53 that includes the suction belt 74 extending in the right and left direction at the center of the front-back direction of the sheet S1.

The control circuit 15 may display an image captured by the image capture section 93 on the display unit 95. The user may operate the image forming apparatus 1 according to the image to adjust the amount of floating air and separating air.

The direction $\alpha$1 and image capture direction $\alpha$2 must not be oriented toward the front side or back side. This is because if direction $\alpha$1 is oriented toward the front side or back side, light cannot be emitted to the front end E1 of the sheet S1 or the front end E2 of the sheet S2. Similarly, if the image capture direction $\alpha$2 is oriented toward the front side or back side, an image of light emitted to the front end E1 of the sheet S1 and the front end E2 of the sheet S2 cannot be captured.

The method of extracting the singular points p1 and p2 is not limited to the methods described in the above embodiments. The singular point p1 may not be at the leftmost position on the illuminated area SL1. Similarly, the singular point p2 may not be at the leftmost position on the illuminated area SL2.

Instead of calculating a vertical clearance between the topmost sheet S1 and a second sheet S2 below it, a vertical clearance between the second sheet S2 and a third sheet may be calculated. That is, it suffices to calculate a vertical clearance between any two consecutive sheets of a plurality of floated sheets.

Although the present invention has been described in connection with the preferred embodiment above, it is to be noted that various changes and modifications are possible to those who are skilled in the art. Such changes and modifications are to be understood as being within the scope of the invention.

What is claimed is:

1. A sheet supply apparatus comprising:

a tray on which a stack of sheets, which is formed with a plurality of vertically stacked sheets, is capable of being placed;

an air blowing section that blows air toward the stack of sheets placed on the tray to float at least a topmost sheet;

a sucking and conveying section that sucks the topmost sheet floated by the air blowing section and conveys the topmost sheet in a prescribed conveying direction, the sucking and conveying section being disposed above the tray;

a first light source that emits a first slit light which is a stripshaped light having a component extending vertically, wherein the first slit light is emitted toward a face which is a side face of the stack of sheets and which is orthogonal to the prescribed conveying direction, so that the stripshaped first slit light crosses at least a first edge of a first sheet and a second edge of a second sheet below the first sheet, the first sheet and the second sheet being part of a plurality of floated sheets;

an image capture section that captures an image of the first slit light emitted to the first sheet and the second sheet, the image capture section being oriented in an image capture direction that is different, in a plane parallel to the first sheet and the second sheet, from a direction in which the first slit light is emitted from the first light source;

a calculating section that calculates a vertical clearance between the first sheet and the second sheet according to the image of the first slit light captured by the image capture section; and an air amount adjusting section that adjusts an amount of air to be blown by the air blowing section according to the vertical clearance between the first sheet and the second sheet calculated by the calculating section.

2. The sheet supply apparatus according to claim 1, wherein the direction in which the first slit light is emitted, and the image capture direction, are substantially parallel to the first sheet and the second sheet.

3. The sheet supply apparatus according to claim 2, further comprising a second light source that emits a second slit light which is a stripshaped light having a component extending vertically, and which crosses the first edge and the second edge, wherein the second light source is disposed above or below the first light source.

4. The sheet supply apparatus according to claim 1, further comprising a second light source that emits a second slit light which is a stripshaped light having a component extending vertically, which illuminates a position on the first edge, the position being different from a position illuminated by the first slit light on the first edge, and which also illuminates a position on the second edge, the position being different from a position illuminated by the first slit light on the second edge.

5. The sheet supply apparatus according to claim 1, wherein:

the first slit light illuminates the first edge so that a first illuminated area is formed on an upper surface or a lower surface of the first sheet, the first illuminated area being stripshaped and extending diagonally upward or downward, starting from the first edge;

the image capture section captures an image of the first illuminated area; and the calculating section extracts a first singular point on the first edge based on the image of the first illuminated area captured by the image capture section.

6. The sheet supply apparatus according to claim 5, wherein the calculating section extracts, as the first singular point, a point in the first illuminated area, the point being at an upstream end of a component in a horizontal direction of a direction in which the first illuminated area extends from the first edge.

7. The sheet supply apparatus according to claim 6, wherein:

the first slit light illuminates the second edge so that a second illuminated area is formed on an upper surface or a lower surface of the second sheet, the second illuminated area being stripshaped and extending diagonally upward or downward, starting from the second edge;

the image capture section captures an image of the first illuminated area and the second illuminated area; and the calculating section extracts, as a second singular point, a point in the second illuminated area, the point being at an upstream end of a component in a horizontal direction of a direction in which the second illuminated area extends from the second edge, and the calculating section calculates the vertical clearance between the first sheet and the second sheet according to a vertical clearance between the first singular point and the second singular point.

8. The sheet supply apparatus according to claim 7, wherein if the vertical clearance between the first sheet and the second sheet is within a normal range, the air amount adjusting section does not change the amount of air to be blown by the air blowing section.

9. The sheet supply apparatus according to claim 8, wherein if the vertical clearance between the first sheet and the second sheet is larger than an upper limit of the normal range, the air amount adjusting section reduces the amount of air to be blown by the air blowing section.

10. The sheet supply apparatus according to claim 8, wherein if the vertical clearance between the first sheet and the second sheet is smaller than a lower limit of the normal range, the air amount adjusting section increases the amount of air to be blown by the air blowing section.

11. The sheet supply apparatus according to claim 6, wherein:

the first slit light illuminates the second edge so that a second illuminated area is formed on an upper surface or a lower surface of the second sheet, the second illuminated area being stripshaped and extending diagonally upward or downward, starting from the second edge;

the image capture section captures an image of the first illuminated area and the second illuminated area; and the calculating section extracts, as a second singular point, a point in the second illuminated area, the point being at an upstream end of a component in a horizontal direction of a direction in which the second illuminated area extends from the second edge, and the calculating section calculates a displacement between the first sheet and the second sheet in the horizontal direction based on the first singular point and the second singular point.

12. The sheet supply apparatus according to claim 1, wherein the image capture section and the first light source are disposed downstream of the stack of sheets in the prescribed conveying direction.

13. The sheet supply apparatus according to claim 1, wherein:

the first slit light illuminates the first edge so that a first illuminated area is formed on an upper surface or a lower surface of the first sheet, the first illuminated area being stripshaped and extending diagonally upward or downward, starting from the first edge;

the image capture section captures an image of the first illuminated area; and the sheet supply apparatus further has a determining section that determines a state in which the first sheet is curled, according to the image of the first illuminated area captured by the image capture section.

14. The sheet supply apparatus according to claim 13, wherein the determining section determines that the first sheet is curled so that the first edge faces downward if the first illuminated area extends upward at angle starting from the first edge, and determines that the first sheet is curled so that the first edge faces upward if the first illuminated area extends downward at angle starting from the first edge.

15. The sheet supply apparatus according to claim 1, wherein the image capture direction matches a direction of an optical axis of the image capture section.

16. A sheet supply apparatus comprising:

a tray on which a stack of sheets, which is formed with a plurality of vertically stacked sheets, is capable of being placed;

an air blowing section that blows air toward the stack of sheets placed on the tray to float at least a topmost sheet;

a sucking and conveying section that sucks the topmost sheet floated by the air blowing section and conveys the topmost sheet in a prescribed conveying direction, the sucking and conveying section being disposed above the tray;

a light source that emits a light that forms an outer edge of an illumination range having a component extending vertically, wherein the light is emitted toward a face which is a side face of the stack of sheets and which is orthogonal to the prescribed conveying direction so that the outer edge having the component extending vertically crosses a first edge of a first sheet and a second edge of a second sheet below the first sheet;

an image capture section that captures an image of the outer edge crossing the first edge and the second edge, the image capture section being oriented in an image capture direction that is different, in a plane parallel to the first sheet and the second sheet, from a direction in which the light is emitted from the light source;

a calculating section that calculates a vertical clearance between the first sheet and the second sheet according to the image of the outer edge captured by the image capture section; and an air amount adjusting section that adjusts an amount of air to be blown by the air blowing section according to the vertical clearance between the first sheet and the second sheet calculated by the calculating section.

17. A sheet supply apparatus comprising:

a tray on which a stack of sheets, which is formed with a plurality of vertically stacked sheets, is capable of being placed;

an air blowing section that blows air toward the stack of sheets placed on the tray to float at least a topmost sheet;

a sucking and conveying section that sucks the topmost sheet floated by the air blowing section and conveys the topmost sheet in a prescribed conveying direction, the sucking and conveying section being disposed above the tray;

a light source that emits a slit light which is a stripshaped light extending diagonally with respect to a vertical direction of the plurality of vertically stacked sheets, wherein the slit light is emitted toward a face which is a side face of the stack of sheets and which is orthogonal to the prescribed conveying direction so that the stripshaped first light crosses a first edge of a first sheet and a second edge of a second sheet below the first sheet, the first sheet and the second sheet being part of a plurality of floated sheets;

an image capture section that captures an image of the slit light emitted to the first sheet and the second sheet;

a calculating section that calculates a vertical clearance between the first sheet and the second sheet according to the image of the slit light captured by the image capture section; and an air amount adjusting section that adjusts an amount of air to be blown by the air blowing section according to the vertical clearance between the first sheet and the second sheet calculated by the calculating section.

18. A sheet supply apparatus comprising:

a tray on which a stack of sheets, which is formed with a plurality of vertically stacked sheets, is capable of being placed;

an air blowing section that blows air toward the stack of sheets placed on the tray to float at least a topmost sheet;

a sucking and conveying section that sucks the topmost sheet floated by the air blowing section and conveys the topmost sheet in a prescribed conveying direction, the sucking and conveying section being disposed above the tray;

a light source that emits a light that forms an outer edge of an illumination range, wherein the light is emitted toward a face which is a side face of the stack of sheets and which is orthogonal to the prescribed conveying direction so that the outer edge extends diagonally with respect to a vertical direction of the plurality of vertically stacked sheets and crosses a first edge of a first sheet and a second edge of a second sheet below the first sheet;

an image capture section that captures an image of the outer edge crossing the first edge and the second edge;

a calculating section that calculates a vertical clearance between the first sheet and the second sheet according to the image of the outer edge captured by the image capture section; and an air amount adjusting section that adjusts the amount of air to be blown by the air blowing section according to the vertical clearance between the first sheet and the second sheet calculated by the calculating section.

19. An image forming apparatus comprising the sheet supply apparatus according to claim 1.

20. An image forming apparatus comprising the sheet supply apparatus according to claim 16.

21. An image forming apparatus comprising the sheet supply apparatus according to claim 17.

22. An image forming apparatus comprising the sheet supply apparatus according to claim 18.

23. The sheet supply apparatus according to claim 1, wherein an optical axis of the image capture section is substantially orthogonal to the side face of the stack of sheets.

24. The sheet supply apparatus according to claim 16, wherein an optical axis of the image capture section is substantially orthogonal to the side face of the stack of sheets.

25. The sheet supply apparatus according to claim 17, wherein an optical axis of the image capture section is substantially orthogonal to the side face of the stack of sheets.

26. The sheet supply apparatus according to claim 18, wherein an optical axis of the image capture section is substantially orthogonal to the side face of the stack of sheets.

* * * * *